US005666605A

United States Patent [19]

Tokimatsu et al.

[11] Patent Number: 5,666,605

[45] Date of Patent: Sep. 9, 1997

[54] CHARGING UNIT

[75] Inventors: Hiroyuki Tokimatsu; Satoshi Haneda, both of Hachioji, Japan

[73] Assignee: Konica Corporation, Japan

[21] Appl. No.: 539,863

[22] Filed: Oct. 6, 1995

[30] Foreign Application Priority Data

| | | | |
|---|---|---|---|
| Oct. 11, 1994 | [JP] | Japan | 6-245419 |
| Oct. 18, 1994 | [JP] | Japan | 6-252342 |
| Nov. 2, 1994 | [JP] | Japan | 6-269718 |
| Jan. 11, 1995 | [JP] | Japan | 7-002634 |
| Jan. 24, 1995 | [JP] | Japan | 7-008999 |

[51] Int. Cl.[6] ..... G03G 15/02

[52] U.S. Cl. ..... 399/173; 250/324; 250/325; 361/225

[58] Field of Search ..... 355/219, 271, 355/225; 361/225; 256/326; 250/324, 325; 399/170, 173, 171

[56] References Cited

U.S. PATENT DOCUMENTS

| | | | |
|---|---|---|---|
| 4,949,950 | 8/1990 | Stephaney | 271/193 |
| 5,367,366 | 11/1994 | Kido et al. | 355/225 |
| 5,412,213 | 5/1995 | Kido et al. | 250/326 |
| 5,466,938 | 11/1995 | Nakayama et al. | 250/326 |

*Primary Examiner*—William J. Royer

*Attorney, Agent, or Firm*—Jordan B. Bierman; Bierman, Muserlian and Lucas LLP

[57] ABSTRACT

A corona-discharging type charging device for charging a photoreceptor includes saw tooth-shaped electrodes facing the photoreceptor; side plates applied with a DC bias voltage Vs and provided on both sides of the saw tooth-shaped electrodes; and a control grid applied with a DC bias voltage Vg and provided between the saw tooth-shaped electrodes and the photoreceptor.

18 Claims, 15 Drawing Sheets

FIG. 6
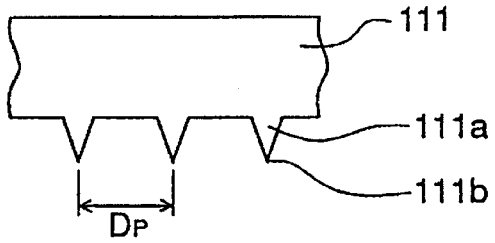
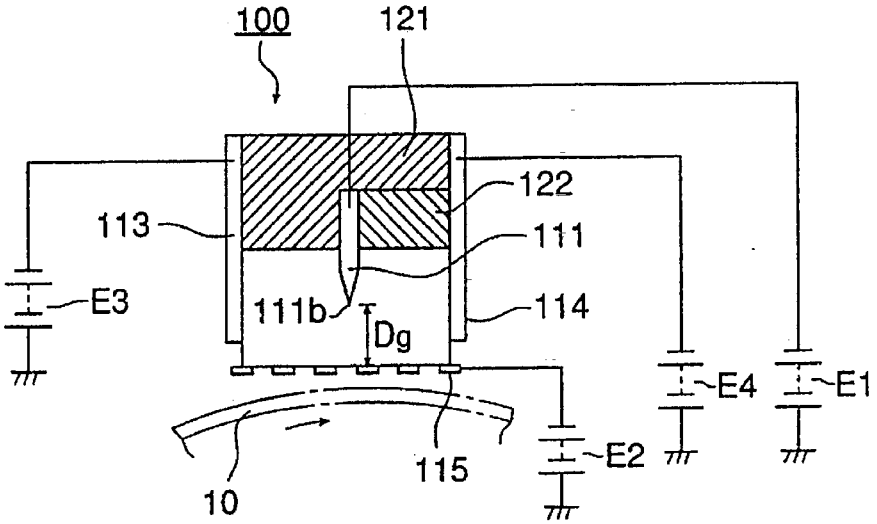
FIG. 7
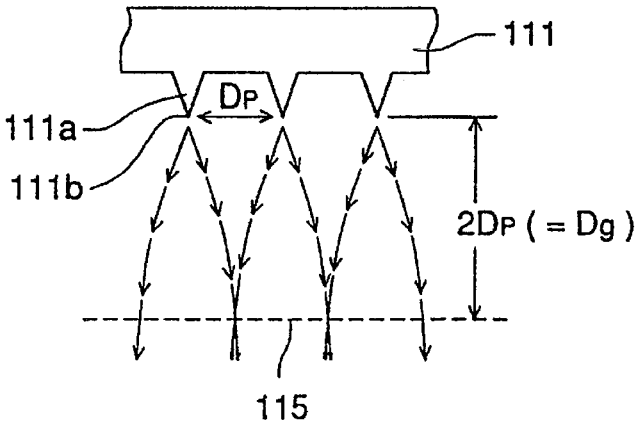
FIG. 8

CHARGING UNIT

BACKGROUND OF THE INVENTION

The present invention relates to a corona discharge type charging unit used for an electrophotographic type image forming apparatus, and more particularly relates to a corona discharge type charging unit in which a non-contact type saw-toothed electrode is used.

Concerning a corona discharge type charging unit used for an electrophotographic type image forming apparatus; there are provided two types charging units. One is a wire discharge type such as corotron, scorotron and dicorotron, and the other is a pin discharge type such as a pin electrode type and a saw-toothed electrode type. The latter generates a very small amount of ozone during its operation. Therefore, the latter is recently used for an electrophotographic type copier or printer. Concerning the structure of the charging unit, Japanese Patent Publication Open to Public Inspection Nos. 15272/1988 and 45999/1993 disclose a charging unit having a saw-toothed electrode section composed of a plurality of saw teeth.

The above charging units have the following disadvantages. In the case of the above wire discharge type charging unit, when a bias voltage impressed upon the discharging electrode is raised to enhance the discharging ability, it is impossible to conduct charging uniformly. In the case of the above charging unit having a saw-toothed electrode section composed of a plurality of saw teeth, the discharging ability is higher than that of the wire discharging type charging unit. However, in the corona discharge of the charging unit having a saw-toothed electrode section composed of a plurality of saw teeth, discharge can not be conducted uniformly by each saw-toothed electrode. In order to make the charging condition uniform, it is necessary to raise the bias voltage so as to increase the discharging current. Accordingly, the charging voltage can not be made to be uniform and stable.

Further, in the case of the charging unit having a saw-toothed electrode section, the following disadvantages are provided. When this charging unit is used for an image forming apparatus provided with a drum-shaped image forming body (photoreceptor drum), in the case of positioning in which the electrode section is not contacted with the surface of the photoreceptor drum, a clearance between the electrode and the photoreceptor drum surface is changed due to the fluctuation of the rotational photoreceptor drum. As a result, the charging voltage is not uniform, so that it can not be stabilized. When a collision roller is used so as to stabilize the rotational fluctuation, the mechanism of the apparatus becomes complicated, and when the photoreceptor drum is rotated, the collision roller bounds, which causes various problems.

The present invention has been accomplished to solve the above problems. A first object of the present invention is to provide a charging unit, the discharging ability of which is high, so that the charging can be conducted uniformly without raising the bias voltage impressed upon the discharging electrode.

In this connection, there is a tendency to downsize an image forming apparatus, so that the structure of the image forming apparatus becomes complicated. Accordingly, there is a demand for downsizing a corona charging unit capable of conducting corona discharge stably. In general, the corona charging unit is covered with a shield member having an opening in the direction of the photoreceptor. In the case of a conventional wire discharge type corona charging unit, an opening angle is reduced when the charging unit is downsized. Accordingly, a quantity of ion to reach the photoreceptor surface is decreased, and a distance from the shield to the corona electrode is shortened, so that a quantity of ion to flow to the shield is increased, and a quantity of electric charge given to the photoreceptor by a control grid is reduced. Further, it is impossible to charge the photoreceptor at the uniform voltage. In order to improve the charging electrode, there is provided a saw-toothed electrode recently. As a result of the experiment made by the present inventors, the following was found. Discharging ability of the saw-toothed electrode was higher than that of the wire discharging system, however, uniform discharge can not be conducted by the saw-toothed electrode. FIG. 15 is a view showing an apparatus to measure uneven charging. Measurement of uneven charging is made as follows. The corona charging unit 400 is provided with a saw-toothed electrode plate 411. The corona charging unit 400 is put into a charging condition. Under the corona charging unit 400, there is provided an aluminum plate 401 on which an insulating layer 402 is formed. At art upper position on the insulating layer 402, there is provided a tungsten wire 403, the diameter of which is 50 μm, which is grounded through an ampere-meter A provided in a direction perpendicular to the longitudinal direction of the corona charging unit 400. The aluminum plate 401 having the tungsten wire 403 is moved in the longitudinal direction of the corona charging unit 400 at a speed of 5 mm/sec. By a current flowing in the tungsten wire 403, the discharging condition is measured. In this way, the unevenness of charging can be measured.

That is, FIG. 14 is a schematic illustration showing a condition of discharge conducted by the corona charging unit in which the saw-toothed electrode plate is used. In FIG. 14, the saw-toothed electrode plate 411 is a discharging electrode of the corona charging unit. When a voltage is impressed upon the saw-toothed electrode plate 411 and the control grid 415, a corona discharge having an orientation is generated between the electrode and the photoreceptor drum. Therefore, almost all ions generated by the discharge are directed from the top 411*b* of the saw-toothed electrode 411a to the control grid 415. Accordingly, discharging can be conducted without being affected by the opening angle, so that the charging performance is not deteriorated. Although the discharging ability of corona discharge conducted by the saw-toothed electrode is higher than the discharging ability of the wire discharging system, discharging from each saw-toothed electrode is not uniform. Especially, the following problems are caused. When a clearance $D_p$ at the top 411*b* of the saw-toothed electrode 411*a* is reduced lower than a predetermined value, an adjacent saw-toothed electrode interferes with the discharge, so that the uniformity of discharge is deteriorated. When the value of $D_p$ is increased, interference of discharge can be avoided between the adjacent teeth, however, the charging intensity of a portion of the image forming body close to the saw-toothed electrode is increased, and the charging intensity of a portion of the image forming body distant from the saw-toothed electrode is not increased. Therefore, it is difficult to charge the image forming body uniformly. In the corona charging unit in which the saw-toothed electrode plate is used, the corona discharge concentrates upon the top of the saw-toothed electrode. Accordingly, charging is not conducted uniformly. Further, when the charging unit is downsized, the electric charge leaks to the shield, so that a spark of electric charge tends to occur.

The above problems are solved by the present invention. A second object of the present invention is to provide a compact corona charging unit capable of charging uniformly without generating a large quantity of ozone, and the corona charging unit is suitably adapted to a color image forming apparatus.

Concerning the color image forming system, the following color image forming apparatus (A) and (B) are well known. The color image forming apparatus (A) is referred to as a multi-rotation system in which the processes of charging, image exposure and development are conducted for each rotation of the image forming body, and toner images of different color are superimposed on the image forming body while the image forming body is rotated by a plurality of times. The color image forming apparatus (B) is referred to as a single-rotation system in which the processes of charging, image exposure and development are conducted by a plurality of times while the image forming body is rotated by one rotation, and the toner images are superimposed within the period.

In the charging unit used for each color image forming apparatus described above, in a period of time in which charging is not required, of course, corona discharging is stopped. Accordingly, when toner powder is scattered while the previously formed toner image passes or in the process of development, the scattered toner powder is deposited on the electrode or grid, so that the charging capacity is deteriorated and the durability is lowered.

In the case of the color image forming apparatus (B), a plurality of charging units successively conduct the discharging operation, so that the stop time of corona discharge is long. When a monochromatic image is formed, only a specific charging unit is operated and other charging units are stopped, so that toner powder is deposited on the stopped charging units. Therefore, the stopped charging units are affected by the deposited toner powder.

The above problems of deposition of toner powder on the corona electrode may be caused in the transfer unit, the separation unit and the pre-transfer charging unit. Therefore, the transfer efficiency of a toner image onto a transfer sheet is lowered, which causes a problem in the separation and conveyance efficiency of transfer sheets.

The above problems have been solved by the present invention. A third object of the present invention is to provide a color image forming apparatus in which deposition of toner powder on the charging and separation units can be prevented by a very simple means so that the problems caused by the deposition of toner powder can be effectively prevented.

SUMMARY OF THE INVENTION

The first object of the present invention can be accomplished by a corona discharge type charging unit in which an electrode plate having a plurality of saw-toothed electrode sections is used. The corona discharge type charging unit comprises: side plates provided on both sides of the electrode plate approximately in parallel with the electrode plate, wherein a DC bias voltage is impressed upon the side plates; and a control grid arranged perpendicularly to the electrode plate on the side of the electrode plate to be charged. In this case, the following inequality is satisfied.

$$0 \leqq (D_s - D_g) \leqq 5 \text{ mm}$$

where $D_s$ is a distance from the side plate to the electrode plate, and $D_g$ is a distance from the control grid to the end of the electrode of the electrode plate.

The first object of the present invention can be accomplished by a corona discharge type charging unit in which a saw-toothed electrode having a plurality of saw-toothed electrode sections is used. The corona discharge type charging unit comprises: side plates provided on both sides of the saw-toothed electrode approximately in parallel with the saw-toothed electrode, wherein a DC bias voltage is impressed upon the side plates; and a control grid arranged perpendicularly to the saw-toothed electrode on the side of the saw-toothed electrode to be charged. In this case, the following inequality is satisfied.

$$0.5 \leqq V_s/V_g) \leqq 1.5$$

where $V_s$ is a bias voltage impressed upon the side plate, and $V_g$ is a bias voltage impressed upon the control grid.

The first object of the present invention can be accomplished by a corona discharge type charging unit in which a saw-toothed electrode having a plurality of saw-toothed electrode sections is used. The corona discharge type charging unit comprises: side plates provided on both sides of the saw-toothed electrode approximately in parallel with the saw-toothed electrode, wherein a DC bias voltage is impressed upon the side plates; and a control grid arranged perpendicularly to the saw-toothed electrode on the side of the saw-toothed electrode to be charged. In this case, the following inequality is satisfied.

$$0.25 \leqq I_s/I_t \leqq 0.75$$

where $I_t$ is an intensity of electric current flowing into the saw-toothed electrode, and $I_s$ is an intensity of electric current flowing into the side plate.

The second object of the present invention can be accomplished by a corona charging unit having a saw-toothed electrode plate for corona discharge use in which a plurality of saw-toothed electrodes of the same length are provided, and the saw-toothed electrode plate is arranged perpendicularly to the moving direction of an image forming body on which a latent image is formed. The corona charging unit comprises: a support member for supporting the saw-toothed electrode plate; and a control grid for controlling the corona discharge conducted by the saw-toothed electrode, wherein $D_p$ is not less than 1 mm and not more than 4 mm, and $D_g$ is not more than $2D_p$, where $D_p$ is an interval of the tops of the saw-toothed electrode of the saw-toothed electrode plate, and $D_g$ is an interval of the top of the saw-toothed electrode and the control grid.

The following are preferable embodiments of the present invention. A corona charging unit in which shield members to control an ion flow are provided at both ends of the saw-toothed electrode plate in parallel with the saw-toothed electrode plate; a corona charging unit in which DC voltage is impressed upon the above shield members; and a corona charging unit in which DC voltage is impressed upon the control grid provided in the corona charging unit, and the DC voltage impressed upon the control grid is set to be lower than the DC voltage impressed upon the shield member.

The second object of the present invention can be accomplished by a corona charging unit having a saw-toothed electrode plate for corona discharge use in which a plurality of saw-toothed electrodes of the same length are provided, and the saw-toothed electrode plate is arranged perpendicularly to the moving direction of an image forming body on which a latent image is formed. The corona charging unit comprises: a support member for supporting the saw-toothed electrode plate; a control grid for controlling the corona discharge conducted by the saw-toothed electrode; and conductive shield members for controlling an ion flow, the conductive shield members being arranged on both sides of the saw-toothed electrode plate in parallel with the saw-toothed electrode plate, wherein a side of the shield member in the longitudinal direction opposed to the saw-toothed electrode plate has recesses and protrusions, the intervals of which are the same as those of the saw-toothed electrode provided on the saw-toothed electrode plate, and portions close to the tops of the saw-toothed electrode are arranged corresponding to the recesses.

The following is a preferable embodiments of the present invention. Around the image forming body, there are provided a corona charging unit, an image exposure unit, and a plurality of developing units. When the image forming body is rotated by a plurality of times, charging by the corona charging unit, image exposure by the image exposure unit and development by the developing units are repeatedly conducted so that toner images are superimposed on the image forming body. After the completion of the toner image, it is simultaneously transferred onto a transfer sheet.

The second object can be accomplished by an image forming apparatus in which charging, image exposure and development are conducted on a circumferential surface of the image forming body so as to form a toner image, and the formed toner image is transferred onto a transfer sheet. In the image forming apparatus, the charging unit is provided with a saw-toothed electrode in which tip portions directed to the circumferential surface of the image forming body are arranged in the axial direction of the image forming body, and the charging unit impresses a rectangular wave-form voltage upon the saw-toothed electrode, wherein the rectangular wave-form voltage repeats a predetermined voltage for generating a corona discharge in the process of charging and a predetermined voltage for stopping a corona discharge.

The above second object can be accomplished by the following color image forming apparatus. In the color image forming apparatus, in the circumferential direction of the rotational drum-shaped image forming body, there are provided a cleaning unit, 4 sets of charging units, 4 sets of image exposure means, 4 sets of developing units and 4 sets of transfer means, wherein charging, image exposure and development are repeated on the circumferential surface of the image forming body and the formed different color toner images are superimposed so as to form a color image. In this image forming apparatus, 2 developing units are arranged on the right of the vertical line passing through the center of the image forming body and the residual 2 developing units are arranged on the left of the vertical line passing through the center of the image forming body. The cleaning unit and the transfer unit are arranged on the upstream and downstream sides of the right and left developing units. There is provided a parallel wall, the length of which is approximately the same as the width of the image forming body. There is provided a saw-toothed discharging electrode, the tip portions of which are extended in parallel with the parallel wall and directed to the circumferential surface of the image image forming body. Each charging unit is provided with a control electrode between the saw-toothed discharging electrode and the circumferential surface of the image forming body. The charging unit disposed between the upper and lower developing units or between the developing unit and the cleaning unit is arranged in such a manner that the parallel wall is arranged in parallel with the developing unit, and the control electrode is inclined with respect to the saw-toothed discharging electrode and opposed to the circumferential surface of the image forming body approximately in parallel with it.

In the image forming apparatus in which the saw-toothed discharging electrode, which generates less ozone, is used, a rectangular wave-form voltage, in which a predetermined voltage to generate a corona discharge on the saw-toothed electrode and a predetermined voltage to stop a corona discharge are periodically repeated, is impressed as the discharge voltage. Accordingly, the image forming body can be stably charged, so that an image of high quality can be formed.

In the color image forming apparatus in which the saw-toothed discharging electrode, which generates less ozone, is used, the charging unit is opposed to an inclined portion of the circumferential surface of the image forming body between the 2 developing units disposed vertically on the right of the vertical line passing through the center of the image forming body or between the 2 developing units disposed vertically on the left of the vertical line passing through the center of the image forming body, or alternatively the changing unit is opposed to an inclined portion of the circumferential surface of the image forming body between the cleaning unit and the developing unit on the upstream side. The charging unit is arranged being opposed to the circumferential surface of the image forming body approximately in parallel with it in such a manner that the saw-toothed discharging electrode is parallel with the developing unit, and the control electrode is inclined with respect to the saw-toothed discharging electrode. Accordingly, the color image forming apparatus can be made compact.

The third object of the present invention can be accomplished by the following color image forming apparatus. On the circumferential surface of the image forming body, there are provided a charging means for charging the image forming body, an image exposure means for forming a latent image, and a developing means for making a latent image to be visual, and charging, image exposure and development are repeatedly conducted on the image forming body, and the formed toner images are superimposed. After that, the superimposed images are simultaneously transferred onto a transfer sheet. In this color image forming apparatus, the charging means includes a discharging electrode, a shield member, and a control grid. In the case where images are not formed or the apparatus is not used, a voltage, the polarity of which is the same as that of toner, the voltage being not a discharge voltage, is impressed upon the discharging electrode, the shield member and the control grid.

The third object of the present invention can be accomplished by the following color image forming apparatus. On the circumferential surface of the image forming body, there are provided a charging means for charging the image forming body, an image exposure means for forming a latent image, and a developing means for making a latent image to be visual, and charging, image exposure and development are repeatedly conducted on the image forming body, and the formed toner images are superimposed. After that, the superimposed images are simultaneously transferred onto a transfer sheet. Then the transfer sheet is electrically discharged by a separation means so that the transfer sheet is separated from the image forming body. In the case where the transferring and separating operation is not conducted or the apparatus is not used, a voltage, the polarity of which is the same as that of toner, the voltage being not a discharge voltage, is impressed upon the respective discharging electrodes.

BRIEF DESCRIPTION OF THE DRAWINGS

FIG. 6 is a view showing the saw-shaped electrode plate of a scorotron charging unit.

FIG. 7 is a sectional arrangement view of the scorotron charging unit including a saw-shaped electrode plate that is an example of the corona charging unit of the fourth example.

FIG. 8 is a view showing the discharging condition of the scorotron charging unit of the fourth example.

DETAILED DESCRIPTION OF THE PREFERRED EMBODIMENT

Figure 4:
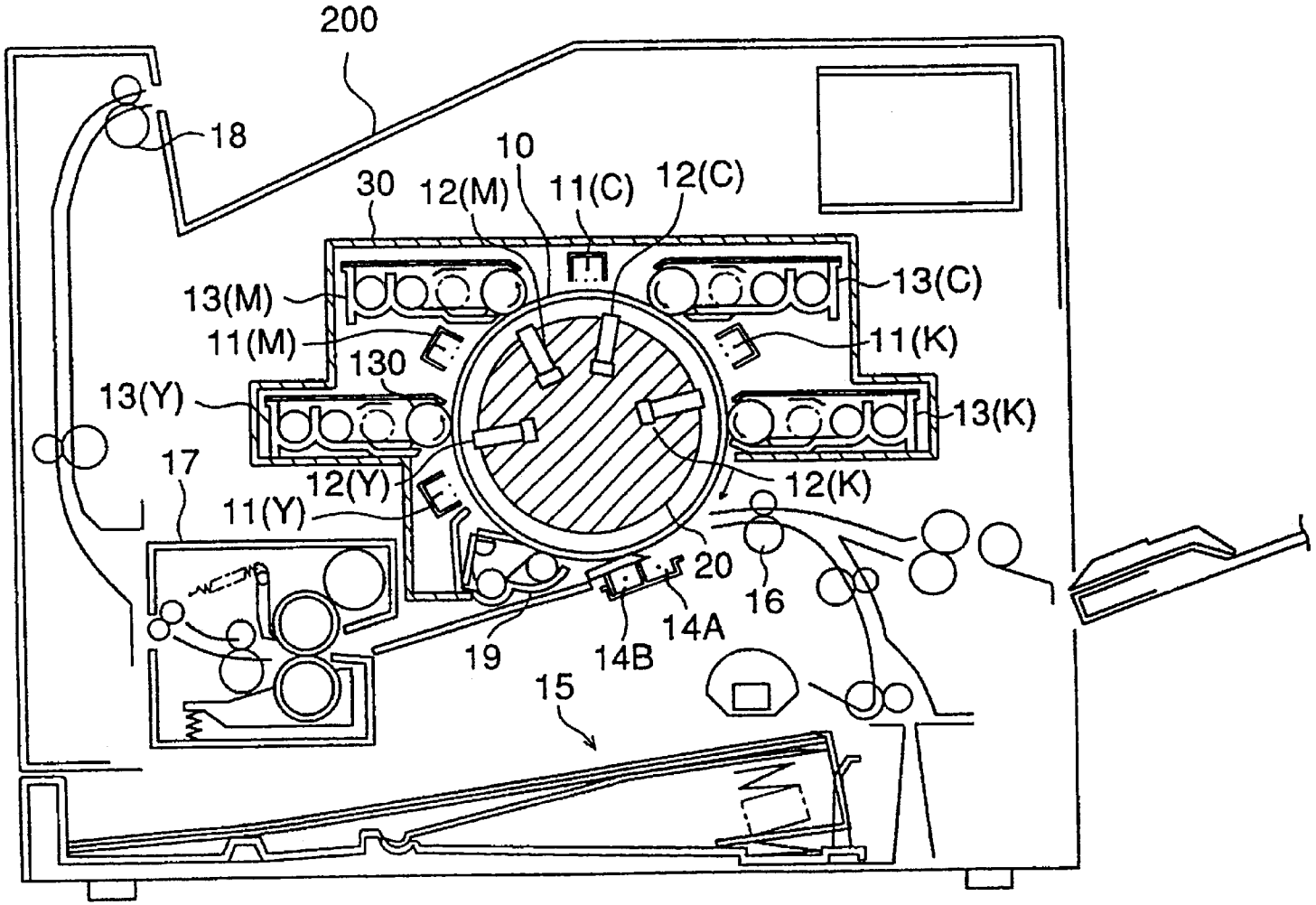
FIG. 4 is an arrangement view of the color image forming apparatus to which the charging unit of the present invention is suitably assembled.

FIG. 4 is an arrangement view showing an example of the color image forming apparatus suitably provided with the charging unit of the present invention. In the drawing, numeral 10 is a drum-shaped image forming body, that is, a photoreceptor drum. The photoreceptor drum 10 is composed in the following manner. The photoreceptor drum 10 includes a cylindrical base body made of transparent material such as optical glass or transparent acrylic resin. On the outer circumference of the cylindrical base body, there are provided a transparent conductive layer and a photoconductive layer made of an organic photo-conductor (OPC) and α-Si.

One end portion of the photoreceptor drum 10 is supported by a flange guide pin, and a flange at the other end portion is engaged with a plurality of guide rollers mounted on the base plate of the apparatus body. When an outer circumferential gear is meshed with a drive gear, the photoreceptor drum 10 is rotated clockwise under the condition that the transparent conductive layer is grounded.

Reference numerals 11(Y), 11(M), 11(C) and 11(K) are charging units of the present invention respectively used for the image formation processes of yellow (Y), magenta (M), cyan (C) and black (K). The charging units conduct the charging operation on the organic photoconductive layer on the photoreceptor drum 10 by the action of a grid, the voltage of which is maintained at a predetermined value, and the action of corona discharge conducted by a saw-toothed electrode. In this way, the charging units uniformly charge the photoreceptor drum 10.

Reference numerals 12(Y), 12(M), 12(C) and 12(K) compose an image exposure optical system including light emitting elements such as LED, FL, EL and PL and also including image formation elements such as a selfoc lens. Image signals of the respective colors, which have been read out by an image reading apparatus provided separately, are successively picked up from the memory and inputted into the exposure optical systems 12(Y), 12(M), 12(C) and 12(K) as electric signals.

The exposure optical systems 12(Y), 12(M), 12(C) and 12(K) are attached to a cylindrical support member 20 fixed to the base plate of the main body through guide pins. In this way, the exposure optical systems 12(Y), 12(M), 12(C) and 12(K) are accommodated in the base body of the photoreceptor drum 10. The exposure optical systems 12 may includes: an optical shutter member such as LCD, LISA and PLZT; and an image formation element such as a selfoc lens.

Reference numerals 13(Y) to 13(K) are developing units which are developing means for accommodating developers of yellow (Y), magenta (M), cyan (C) and black (K). Each developing unit is provided with a developing sleeve 130 rotated in the same direction as that of the photoreceptor drum 10 under the condition that a predetermined clearance is maintained between the developing sleeve 130 and the circumferential surface of the photoreceptor drum 10.

In this case, an electrostatic latent image is formed on the photoreceptor drum 10 by the charging action of the charging units 11(Y), 11(M), 11(C) and 11(K) and also by the image exposure action of the exposure optical systems 12(Y), 12(M), 12(C) and 12(K). The thus formed electrostatic latent image is subjected to reversal development by the developing units 13(Y), 13(M), 13(C) and 13(K) under the condition that a developing bias voltage is impressed upon the developing sleeve. In this case, a non-contact developing system is employed.

In this case, a document image is read by an image pickup element of the image reading apparatus installed separately from the main apparatus. The thus obtained image data or image data compiled by a computer is processed, so that the image data is changed into image signals of Y, M, C and K. The image signals are temporarily stored in the memory.

At the start of image recording, the photoreceptor drive motor is set in motion. Therefore, the photoreceptor drum 10 is rotated clockwise. At the same time, the photoreceptor drum 10 is given an electric potential by the charging action of the charging unit 11Y.

After the photoconductive layer on the photoreceptor drum 10 has been given an electric potential, image exposure is started in the exposure optical system 12(Y) by an electric signal corresponding to the first color signal, that is, an image signal of yellow (Y). In cooperation with the subsidiary scanning conducted by the rotation of the photoreceptor drum 10, an electrostatic latent image corresponding to the yellow (Y) image of the document image is formed on the photoconductive layer on the surface of the photoreceptor drum 10. The above electrostatic latent image is subjected to reversal development by the action of the developing unit 13(Y) under the condition that the developer on the developing sleeve is not contacted. Therefore, a toner image of yellow (Y) is formed in accordance with the rotation of the photoreceptor drum 10.

Next, the photoreceptor drum 10 is given an electric potential on the yellow (Y) toner image by the charging unit 11(M). Then, image exposure is conducted by an electric signal corresponding to the second color signal of the exposure optical system 12(M), that is, the image signal of magenta (M). The thus formed latent image is subjected to reversal development by the developing unit 13(M) under the condition of non-contact. In this way, the toner image of magenta (M) is successively superimposed on the toner image of yellow (Y).

By the same process, a toner image of cyan (C) corresponding to the third color signal is formed by the charging unit 11(C), the exposure optical system 12(C) and the developing unit 13(C). By the same process, a toner image of black (K) corresponding to the fourth color signal is formed by the charging unit 11(K), the exposure optical system 12(K) and the developing unit 13(K). While the photoreceptor drum 10 rotates by one revolution, the color toner image is formed on the circumferential surface of the photoreceptor drum 10.

Image exposure on the photoconductive layer of the photoreceptor drum 10 is conducted by each exposure optical system 12 from the inside of the photoreceptor drum 10 via the aforementioned transparent base body. Consequently, image exposure corresponding to the second, third and fourth color signals is conducted under the condition that the exposing light is not transmitted by the previously formed toner images. Therefore, it is possible to form an electrostatic latent image, the quality level of which is the same as that of the image corresponding to the first color signal. In this connection, a temperature rise of the photoreceptor drum 10 caused by the heat generated in the exposure optical systems 12(Y) to 12(K) can be prevented by using material of high heat conductivity for the support member 20 in such a manner that the generated heat is dissipated outside through a heat pipe. When the temperature of the photoreceptor drum 10 is too low, it can be stabilized by using a heater. In this connection, non-contact reversal development is conducted by each developing unit as follows. A developing bias voltage of DC, or a developing bias voltage in which AC is added to DC is impressed upon the developing sleeve 10, and jumping development is conducted by one-component developer or two-component developer on the photoreceptor drum 10, the transparent conductive layer of which is grounded.

The thus formed color toner image on the circumferential surface of the photoreceptor drum 10 is transferred by the transfer unit 14A onto a transfer sheet conveyed from the sheet feed cassette 15. In this case, the transfer sheet is synchronously fed by the rotation of the timing roller 16.

After the completion of transfer, electric charge on the transfer sheet is removed by the separator 14B, and the transfer sheet is separated from the circumferential surface of the photoreceptor drum 10. Then toner is fused and fixed by the fixing unit 17. After that, the transfer sheet is discharged onto the tray 200 mounted at an upper position of the apparatus.

After the separation of the transfer sheet from the photoreceptor drum 10, residual toner is removed from the photoreceptor drum 10 by the cleaning unit 19. After that, the toner image formation is continued, or alternatively toner image formation is temporarily stopped so as to prepare the next image formation.

Figure 1:
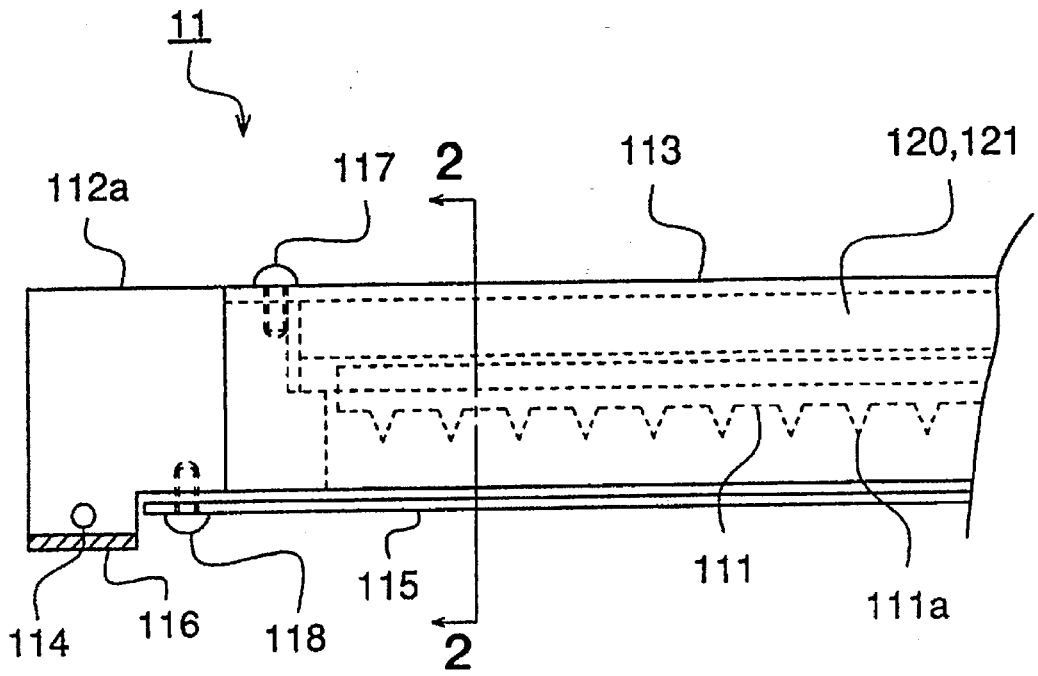
FIG. 1 is a front view showing the arrangement of the charging unit for accomplishing the first object of the present invention.
Figure 2:
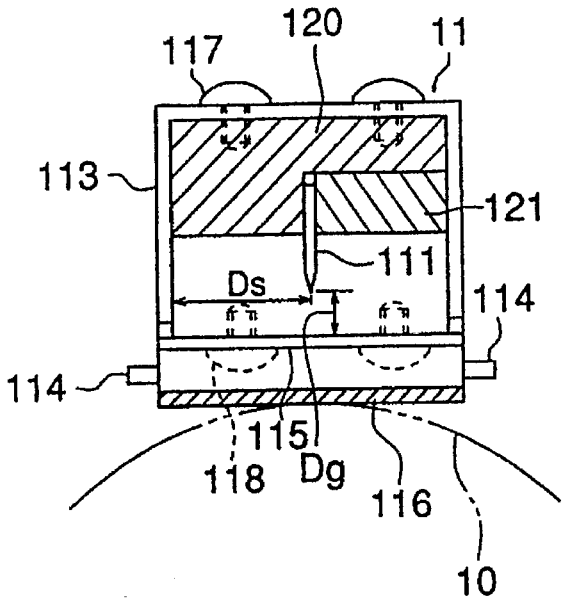
FIG. 2 is a transverse sectional view of the charging unit shown in FIG. 1.
Figure 3:
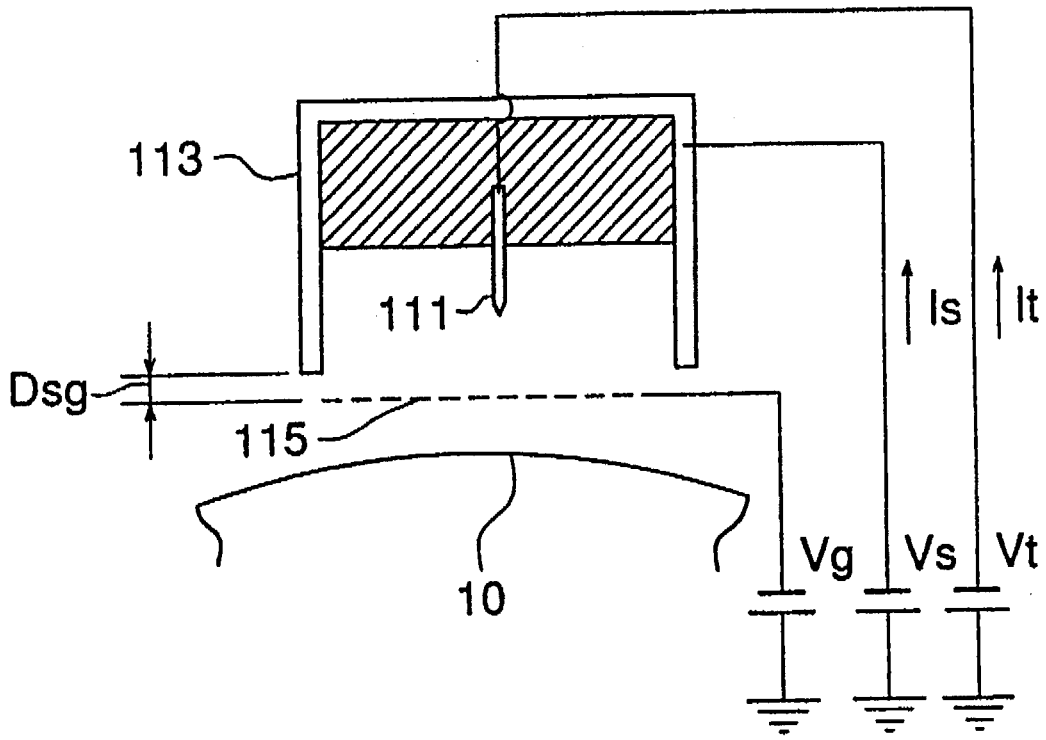
FIG. 3 is a schematic illustration showing the bias voltage top be impressed upon the apparatus of the present invention and also showing the electric current flowing in accordance with the bias voltage.

Next, with reference to FIGS. 1, 3 and 3, an example of the charging unit to accomplish the first object of the present invention will be explained as follows. In this apparatus, the charging units 11(Y), 11(M), 11(C) and 11(K) have the same structure and function. Therefore, the charging units are represented by the reference numeral 12, hereinafter. FIG. 1 is a front view showing the arrangement of the charging unit for accomplishing the first object of the present invention. FIG. 2 is a transverse sectional view of the charging unit shown in FIG. 1, wherein the view is taken on line A—A in FIG. 1. FIG. 3 is a schematic illustration showing the bias voltage top be impressed upon the apparatus of the present invention and also showing the electric current flowing in accordance with the bias voltage.

In the drawings, numeral 111 denotes a saw-toothed electrode for corona discharge use, and the saw-toothed electrode 111 has a plurality of saw-toothed tip portions 111*a* of the equal length protruding toward the photoreceptor drum 10, wherein the plurality of saw-toothed tip portions 111*a* are arranged at regular intervals. For example, the saw-toothed electrode 111 is made as follows. A stainless steel plate, the thickness of which is 0.1 mm, is subjected to etching. The tip portions 111*a* are arranged at the regular interval of 5 mm, wherein the tip portions are machined in such a manner that the radius is not more than 30 μm. Numeral 113 is a side plate made of stainless steel which functions as a shield plate, and the section of the side plate 113 is a C-shape. The saw-toothed electrode 111 is attached to a support member 120 made of insulating resin. Then the saw-toothed electrode 111 is held by a holding member 121 made of the same insulating resin. Both ends of the saw-toothed electrode 111 are held by the front and rear side members 112*a*, 112*b* (not shown in the drawing) made of, for example, ABS resin. Then the saw-toothed electrode 111 is set onto the side plate 113, and then the side plate 113 is fixed to the side members 112a, 112b by the resin screws 117. In this way, the support member 120 for supporting the saw-toothed electrode 111 at the center, the holding member 121 and the side members 112a, 112b are integrally fixed onto the side plate 113.

In this case, a control grid 115 is made of a stainless steel sheet, the thickness of which is 0.1 mm, and the mesh width of which is 1 mm. On the opening side of the side plate 113, the above control grid 115 is attached to the side members 112a, 112b with the resin screws 118 used for attaching the control grid. In this way, the scorotron type charging unit 11 is composed. Numeral 114 is a guide pin integrally provided on the side member 112a on the insertion side, wherein the guide pin 114 is used when the charging unit 11 is inserted into the image forming apparatus body. Numeral 116 is a spacer member attached to the side members 112a, 112b. By the spacer member 116, a predetermined clearance can be maintained between the photoreceptor drum 10 and the charging unit 11, and the spacer member 116 slides on the rotating photoreceptor drum 10 under the condition of line contact. The sliding face of the spacer member 116 is coated with slippery material, for example, fluorocarbon.

The charging unit 11 of the present invention is pushed downward to the photoreceptor drum 10 of the image forming apparatus body by a pushing member having a pushing spring not shown in the drawing. The charging unit 11 of the present invention is positioned by the guide pin 114 mounted on the side member 112a and the guide rail not shown in the drawing. The spacer member 116 comes into contact with both end portions of the photoreceptor drum 10 where no photoconductive layer is provided so that no image is formed. Therefore, the control grid 115 can be accurately maintained at a predetermined position with respect to the photoconductive layer on the photoreceptor drum 10.

The first example will be explained below.

Using the apparatus illustrated in FIG. 4, the present inventors made an experiment of electrically charging the surface of the photoreceptor drum 10 at the voltage of −600 V under the following condition. The outer diameter of the photoreceptor drum 10 having an OPC photoconductive layer was 60 mm. The photoreceptor drum 10 was rotated at the circumferential speed of 80 mm/sec. DC Voltage of −5 kV was impressed upon the electrode plate 111, DC voltage of −400 V was impressed upon the side plate 113, and DC voltage of −600 V was impressed upon the control grid 115.

Discharging orientation of the charging unit having a saw-toothed discharging electrode is higher than the discharging orientation of the charging unit having a wire discharging electrode. Therefore, the charging unit having a saw-toothed discharging electrode is advantageous, because it is difficult for corona ions to flow onto the side plate 113. However, unless a distance from the side plate 113 to the tip portion 111a of the electrode plate 111 and also a distance from the control grid 115 to the tip portion 111a of the electrode plate 111 are set at appropriate values, the aforementioned advantages are not provided. The present inventors made a number of experiments and found the following. When a distance from the side plate 113 to the electrode plate 111 was $D_s$ and a distance from the control grid 115 to the tip portion 111a of the electrode plate 111 was $D_g$, the sufficient discharging ability and the uniformity of charging were provided under the condition that $D_s$=8 mm and $D_g$=5 mm, that is, $D_s-D_g$=3 mm.

Under the above condition, $D_s$ and $D_g$ were varied at random, and the discharging ability and the uniformity of charging were investigated. When the following inequality was satisfied, the sufficient discharging ability and the uniformity of charging were provided while the bias voltage was suppressed to be low.

$$0 \leqq (D_s-D_g) \leqq 5 \text{ mm}$$

When the following inequality was satisfied, that is, when $D_s$ was smaller than $D_g$, almost all corona ions flowed onto the side plate 113.

$$0 > (D_s-D_g)$$

Therefore, the discharging property was lowered.

On the contrary, when $(D_s-D_g)>5$ mm, almost all corona ions flowed in the direction of the control grid 115, so that the corona ions were not smoothed and the uniformity of charging was not provided.

As explained above, the charging unit of the present invention comprises: side plates provided on both sides of the electrode plate approximately in parallel with the electrode plate, wherein a DC bias voltage is impressed upon the side plates; and a control grid arranged perpendicularly to the electrode plate on the side of the electrode plate to be charged. In this case, the following inequality is satisfied.

$$0 \leqq (D_s-D_g) \leqq 5 \text{ mm}$$

where $D_s$ is a distance from the side plate to the electrode plate, and $D_g$ is a distance from the control grid to the end of the electrode of the electrode plate. Therefore, it is possible to provide a charging unit, the discharging property of which is high, and the uniformity of charging is excellent, without raising the bias voltage impressed upon the discharging electrode.

The second example of the present invention will be explained below.

In this example, for the purpose of exhibiting the excellent charging performance, the bias voltage to be impressed upon each portion is regulated.

Using the apparatus illustrated in FIG. 4, the present inventors made an experiment of electrically charging the surface of the photoreceptor drum 10 at the voltage of −600 V under the following condition. The outer diameter of the photoreceptor drum 10 having an OPC photoconductive layer was 60 mm. The photoreceptor drum 10 was rotated at the circumferential speed of 80 mm /sec. Under the condition that $D_s$=8 mm and $D_g$=5 mm, and under the condition that a distance $D_{sg}$ from an end of the side plate 113 to the control grid 115 was $D_{sg}$=2 mm, the charging unit 11 was used for the experiment.

In this case, DC bias voltage of $V_t$ was impressed upon the saw-toothed electrode 111, DC bias voltage of $V_s$ was impressed upon the side plate 113, and DC bias voltage of $V_g$ was impressed upon the control grid 115 as shown in FIG. 3. When $V_t$=−5 KV, $V_s$=−400 V and $V_g$=−600 V, it was possible to provide a sufficiently high discharging ability and a uniform charging property. In this case, $V_s/V_g$=0.67.

The present inventors investigated the discharging ability and the uniformity of charging by changing $V_s$ and $V_g$ at random. As a result of the investigation, the following was found. When $V_s/V_g$<0.5, the discharging ability was excessively lowered, and it was impossible to put it into practical use.

When $V_s/V_g$>1.5, the uniformity of charging was excessively lowered, and it was impossible to put it into practical use.

When the ratio of $V_s/V_g$ was in the following range, both the discharging ability and the uniformity of charging were satisfactorily high without raising the bias voltage $V_r$.

$0.5 \leqq V_s/V_g \leqq 1.5$

The third example of the present invention will be explained below.

In this example, for the purpose of exhibiting the excellent charging performance, the condition of an electric current generated by the bias voltage impressed upon each portion is regulated.

Using the apparatus illustrated in FIG. 4, the present inventors made an experiment of electrically charging the surface of the photoreceptor drum 10 at the voltage of −600 V under the following condition. The outer diameter of the photoreceptor drum 10 having an OPC photoconductive layer was 60 mm. The photoreceptor drum 10 was rotated at the circumferential speed of 80 mm/sec. Under the condition that $D_s$=8 mm and $D_g$=5 mm, and under the condition that a distance $D_{sg}$ from an end of the side plate 113 to the control grid 115 was $D_{sg}$=2 mm, the charging unit 11 was used for the experiment.

In this case, DC bias voltage of $V_t$ was impressed upon the saw-toothed electrode 111, DC bias voltage of $V_s$ was impressed upon the side plate 113, and DC bias voltage of $V_g$ was impressed upon the control grid 115. When the electric current flowing into the saw-toothed electrode 111 was $I_t$ and the electric current flowing into the side plate 113 was $I_s$ as illustrated in FIG. 3, and when $V_t$=−5 KV, $V_s$=−400 V and $V_g$=−600 V, it was possible to provide a sufficiently high discharging ability and a uniform charging property. In this case, the result of measurement of the electric current was as follows. $I_t$=−400 μA, $I_s$=−250 μA, and $I_s/I_t$=0.625.

While the bias voltage Vs impressed upon the side plate 113 was changed under the condition of the same arrangement, $I_s$, $I_t$ and the charging voltage ($V_p$) of the photoreceptor drum 10 were measured, and at the same time, the uniformity of charging on each image recorded under the respective condition was evaluated by the visual inspection. The results are shown on Table 1.

TABLE 1

| $V_S$(−V) | $I_t$(−μA) | $I_S$(−μA) | $I_S/I_t$ | $V_p$(−V) | Uniformity | Good Range |
|---|---|---|---|---|---|---|
| 0 | 470 | 423 | 0.90 | 420 | ○ | |
| 100 | 455 | 377 | 0.829 | 510 | ○ | |
| 200 | 440 | 348 | 0.791 | 592 | ○ | |
| 300 | 421 | 290 | 0.688 | 600 | ○ | ○ |
| 400 | 400 | 250 | 0.625 | 600 | ○ | ○ |
| 500 | 395 | 222 | 0.562 | 600 | ○ | ○ |
| 600 | 391 | 191 | 0.486 | 600 | ○ | ○ |
| 700 | 389 | 152 | 0.391 | 600 | ○ | ○ |
| 800 | 386 | 108 | 0.280 | 600 | ○ | ○ |
| 900 | 379 | 84 | 0.222 | 600 | Δ | |
| 1000 | 362 | 62 | 0.171 | 600 | X | |

In this experiment, since the charging voltage $V_p$ of the photoreceptor drum 10 was controlled to be −600 V, the absolute value of the charging voltage $V_p$ was not increased higher than 600 V. When the charging voltage was lower than 600 V, it represents that the discharging ability was not sufficient.

On Table 1, the following can be understood. In the case of $I_s/I_t$>0.75, the discharging ability was lowered, so that the charging voltage was not increased to a predetermined value.

In the case of $I_s/I_t$<0.25, the uniformity of charging was deteriorated. Therefore, it was impossible to put it into practical use. When the ratio of $I_s$ and $I_t$ was in the following range, a sufficiently high discharging ability and uniformity of charging was provided without increasing the discharging current $I_t$.

$0.25 \leqq I_s/I_t \leqq 0.75$

The above explanations are given for the image forming apparatus in which the photoreceptor is exposed to light from the inside. Of course, the present invention can be applied to the charging unit of the image forming apparatus in which the photoreceptor 10 is exposed to light from the outside.

As explained above, the charging unit of the second example comprises: side plates provided on both sides of the saw-toothed electrode approximately in parallel with the saw-toothed electrode, wherein a DC bias voltage is impressed upon the side plates; and a control grid arranged perpendicularly to the saw-toothed electrode on the side of the saw-toothed electrode to be charged. In this case, the following inequality is satisfied.

$0.5 \leqq V_s/V_g) \leqq 1.5$ where $V_s$ is a bias voltage impressed upon the side plate, and $V_g$ is a bias voltage impressed upon the control grid. Accordingly, the charging unit of high discharging ability and high uniformity of charging can be provided while the bias voltage impressed upon the saw-toothed electrode is not raised so as to increase the discharging current.

The charging unit of the third example of the present invention comprises: side plates provided on both sides of the saw-toothed electrode approximately in parallel with the saw-toothed electrode, wherein a DC bias voltage is impressed upon the side plates; and a control grid arranged perpendicularly to the saw-toothed electrode on the side of the saw-toothed electrode to be charged. In this case, the following inequality is satisfied.

$0.25 \leqq I_s/I_t \leqq 0.75$ where $I_t$ is an intensity of electric current flowing into the saw-toothed electrode, and $I_s$ is an intensity of electric current flowing into the side plate. Accordingly, the charging unit of high discharging ability and high uniformity of charging can be provided while the bias voltage impressed upon the saw-toothed electrode is not raised so as to increase the discharging current $I_t$.

Figure 5:
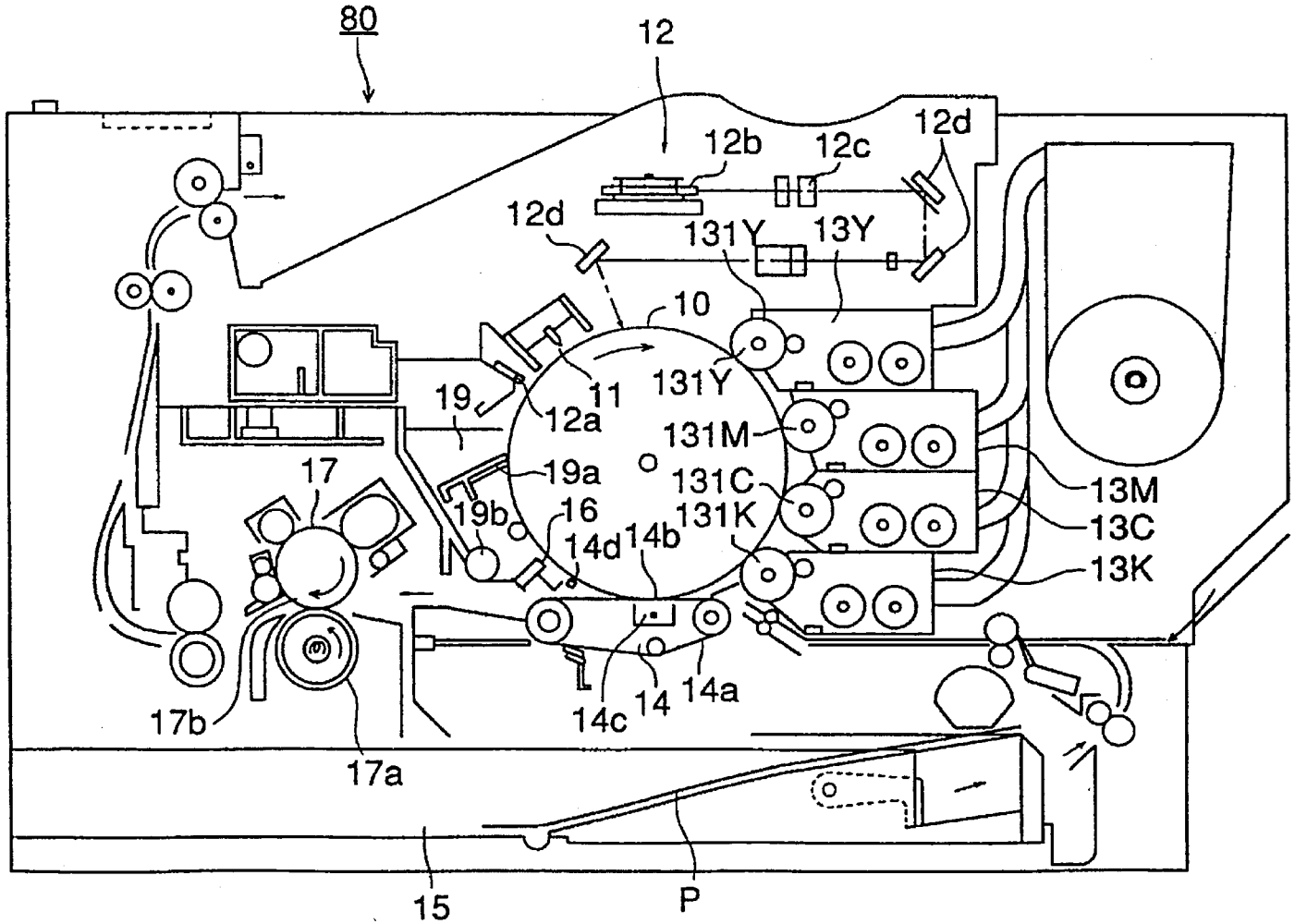
FIG. 5 is a sectional arrangement view of the color laser printer that is an example of the color image forming apparatus to which the corona charging unit for accomplishing the second object of the present invention is assembled.

Before the explanations of the fourth and fifth examples of the corona charging unit to accomplish the second object of the present invention, the image formation process and the mechanism of the image forming apparatus having a scorotron charging unit, which is an example of the corona charging unit and common among the examples of the present invention, will be explained with reference to FIG. 5 in which a color image forming apparatus is shown. FIG. 5 is a sectional arrangement view of the color laser printer 80 which is an example of the color image forming apparatus to which the corona charging unit of the present invention is applied.

The photoreceptor drum 10, which is an image forming body, is rotated clockwise. In order to erase the hysteresis of the photoreceptor, for example, exposure is conducted by the pre-charging uniform exposure means **12*a* in which the light emitting diode is used, so that the circumferential surface of the photoreceptor is electrically discharged. In this way, the electric charge given in the previous printing process can be removed. After the photoreceptor drum 10 has been uniformly charged by the scorotron charging unit 11, image exposure is conducted by the image exposure means 12 in accordance with the image signal. By the image exposure means 12, a laser beam emitted from the laser beam source is subjected to rotary scanning by the action of the rotary polygonal mirror 12*b*. Then the laser beam passes through the fθ lens 12***c*, the reflecting mirror 12*d* and the like. In this way, a latent image is formed on the photoreceptor drum 10.

Around the photoreceptor drum 10, there are provided developing units 13Y, 13M, 13C and 13K respectively having developers composed of carrier and toners of yellow (Y), magenta (M), cyan (C) and black (K). Development of the first color (for example, yellow) is conducted by the developing sleeve 131Y. Development is conducted in such a manner that the development bias in which AC bias and DC bias are superimposed is impressed between the developing sleeve 131Y and the photoreceptor drum 10. In this way, reversal development is conducted under the non-contact condition.

After the completion of development of the first color, the image formation process of the second color (for example, magenta) is started. The photoreceptor drum 10 is uniformly charged by the scorotron charging unit 11, and a latent image according to the image data of the second color is formed by the image exposure means 12. At this time, discharging is not conducted by the uniform exposure means 12*a* unlike the image formation process of the first color. Development of the second color magenta is conducted by the developing sleeve 131M using the second color developer. Development is conducted in such a manner that the development bias in which AC bias and DC bias are superimposed is impressed between the developing sleeve 131M and the photoreceptor drum 10. In this way, reversal development is conducted under the non-contact condition.

Development of the third color (cyan) and development of the fourth color (black) are conducted in the same manner as that of the second color. In this way, toner images of 4 colors are developed and superimposed on the photoreceptor drum 10.

In this apparatus, recording sheets P are accommodated in the transfer sheet accommodating container 15. The recording sheet P is sent to a nip portion (transfer region) 14*b* formed between the photoreceptor drum 10 and the transfer belt 14*a* in timed relation to a toner image formed on the photoreceptor drum 10. A multi-color image on the circumferential surface of the photoreceptor drum 10 is simultaneously transferred onto the recording sheet P by the action of the transfer unit 14*c*. While the multi-color image is being formed, the transfer belt 14*a* is separate from the circumferential surface of the photoreceptor drum 10.

After the completion of transfer of the multi-color image, the recording sheet P is separated from the transfer belt 14 by the action of the separating unit 14*d*. Then, the recording sheet P is conveyed to the fixing unit 17 composed of 2 fixing rollers, at least one of which is provided with a heater in the roller. Recording sheet P is given heat and pressure between the thermally fixing roller 17*a* and the press roller 17*b*. Due to the foregoing, toner deposited on the recording sheet P is thermally fixed, and then the recording sheet P is sent outside of the apparatus.

After the completion of transfer, the residual toner on the circumferential surface of the photoreceptor drum 10 is electrically discharged by the discharger 16. Then the residual toner is conveyed to the cleaning unit 19 and scraped off by the cleaning blade 19*a* made of rubber which comes into contact with the photoreceptor drum 10. The scraped toner drops inside the cleaning unit 19 and is recovered into a used toner container (not shown) by the action of the screw 19*b*. After the residual toner has been removed from the photoreceptor drum 10 by the cleaning unit 19, the photoreceptor drum 10 is subjected to uniform exposure by the scorotron charging unit 11, and then the next image formation cycle starts. During the multi-color image formation, the cleaning blade 19*a* is maintained to be separate from the photoreceptor drum 10.

The fourth example of the present invention will be described as follows.

Figure 9:
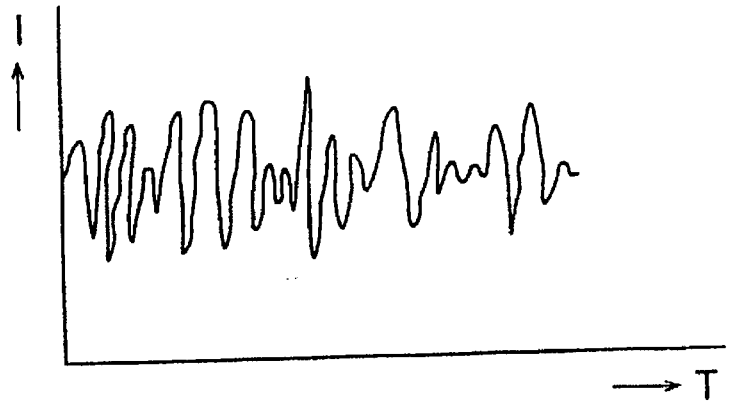
FIGS. 9(A) to 9(C) is a view showing the result of measurement of fluctuation of charging of the scorotron charging unit.
Figure 9:
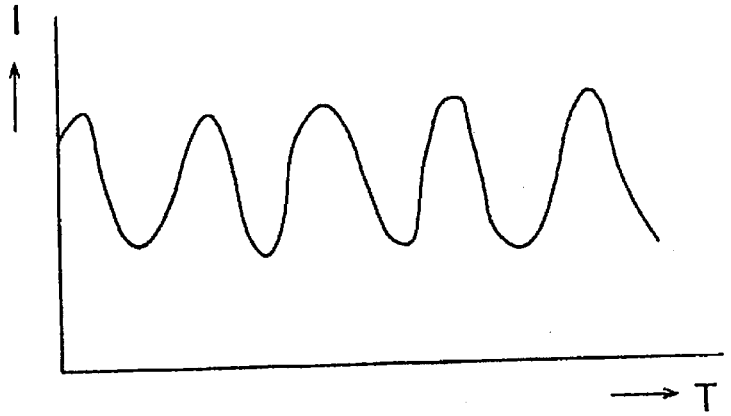
Figure 9:
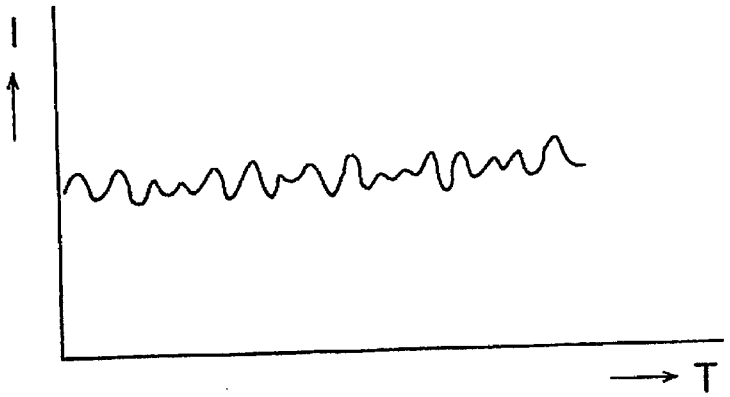
Figure 10:
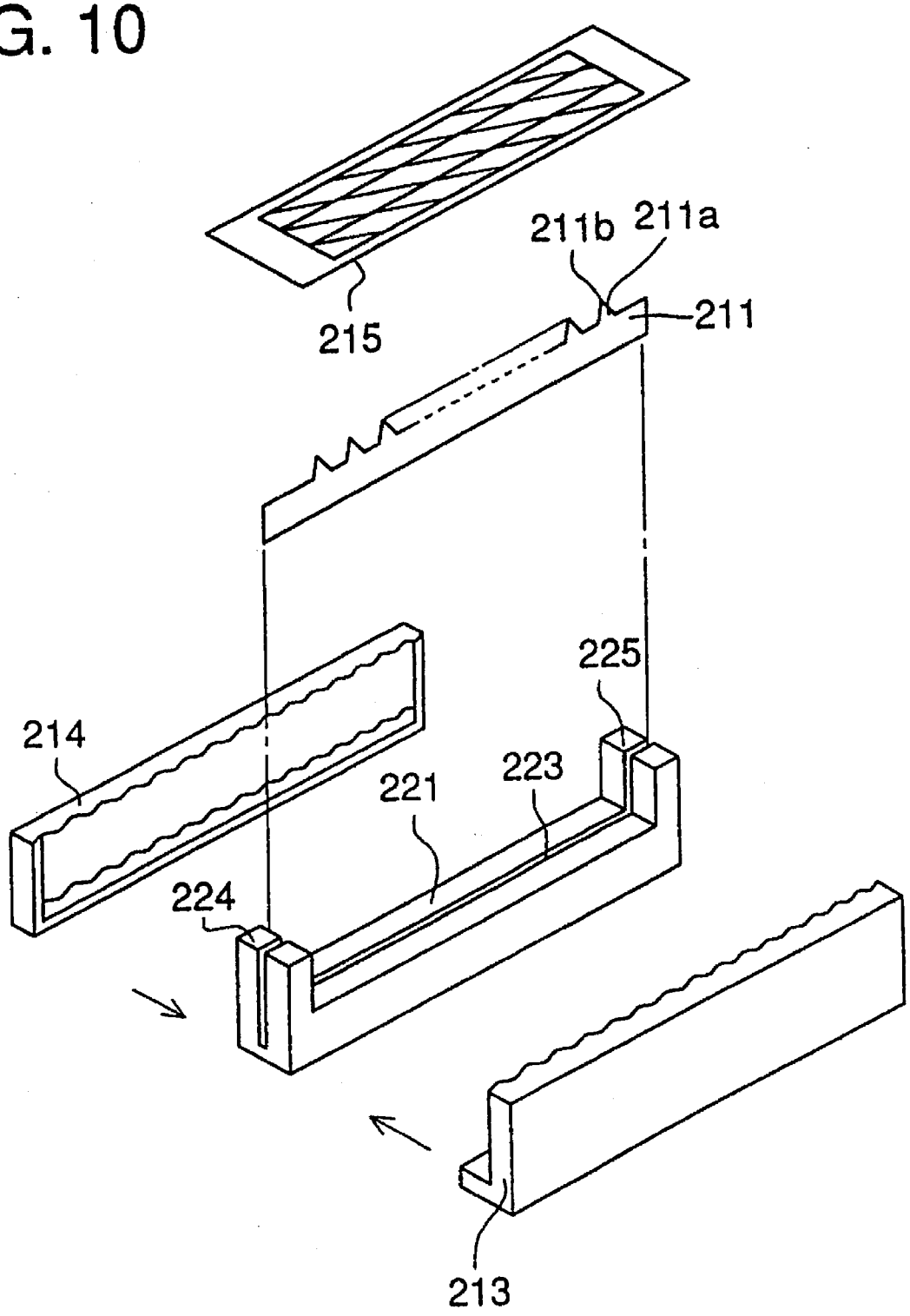
FIG. 10 is an arrangement view showing an outline of the scorotron charger having a saw-toothed electrode plate that is an example of the corona charging unit of the fifth example.

The scorotron charging unit, which is an example of the corona charging unit of the fourth example of the present invention, will be explained with reference to FIGS. 6 to 9. FIG. 6 is a view showing a saw-toothed electrode plate of the scorotron charging unit. FIG. 7 is a sectional view showing an arrangement of the scorotron charging unit having a saw-toothed electrode plate of the fourth example of the present invention. FIG. 8 is a view showing a discharging condition of the scorotron charging unit of the fourth example. FIGS. 9(A) to 9(C) are graphs showing the uneven charging conditions of the scorotron charging unit.

The saw-toothed electrode plate 111 is provided with a saw-toothed electrode 111*a* in which a plurality of tops 111*b* of the saw-toothed electrode 111*a* are disposed at regular intervals, wherein the lengths of the saw-teeth are the same. The saw-toothed electrode plate 111 is used for corona discharging and arranged in a direction perpendicular to the moving direction of the photoreceptor drum 10 which is the image forming body. The saw-toothed electrode 111 is manufactured, for example, in such a manner that a stainless steel sheet, the thickness of which is 0.1 mm, is subjected to etching. The radius of curvature of the top 111*b* of the saw-toothed electrode 111*a* is not more than R=40 μm. The control grid 115 is manufactured, for example, in such a manner that a stainless steel sheet, the thickness of which is 0.1 mm, is subjected to etching. In this case, the mesh size is 1 mm. Each of the side plates 113, 114, which is a shield member, is made of one sheet of stainless steel.

The scorotron charging unit 100, which is a corona charging unit, is composed as follows. The saw-toothed electrode plate 111 is attached to a support member 121 made of insulating resin, for example, ABS resin. Then the saw-toothed electrode plate 111 is interposed between the holding members 122 made of the same insulating resin, for example, ABS resin. The side plates 113, 114 are disposed in parallel with the longitudinal direction of the saw-toothed electrode plate 111. Under the condition that the saw-toothed electrode plate 111 and the holding member 122 are attached at both ends of the support member 121, they are fixed to the support member 121 with screws made of resin, and further the control grid 115 is attached to the support member 121. In this connection, an interval between the top 111*b* of the saw-toothed electrode 111*a* and the control electrode 115 is represented by $D_g$.

To the image forming apparatus, the aforementioned scorotron charging unit 100 is assembled in such a manner that the scorotron charging unit 100 is opposed to the photoreceptor drum 10. In the case of image formation, DC voltage E1 is impressed upon the saw-toothed electrode plate 111, DC voltage E2 is impressed upon the control grid 115, and DC voltages E3 and E4 are impressed upon the side plates 113 and 114. The DC voltages impressed upon the side plates 113 and 114 may be the same. Since the supporting member 121 for supporting the saw-toothed electrode plate 111 is provided, it is not necessary to use the conventional C-shaped side plate, one face of which is provided in an upper portion of the saw-toothed electrode. The side plates 113 and 114 are individually arranged on both sides. When the side plates 113 and 114 are arranged on both sides, it is possible to prevent foreign objects from flowing into the apparatus. When the voltages impressed upon the side plates 113, 114 are separately controlled, corona discharge can be controlled in such a manner that a current of ions are maintained in a good condition. It is possible to provide the side plate only on one side. Only the side plate 113 may be provided only on the upstream side of the rotation of the photoreceptor drum 10, and voltage may be impressed and controlled only upon the above side plate 113.

Figure 15:
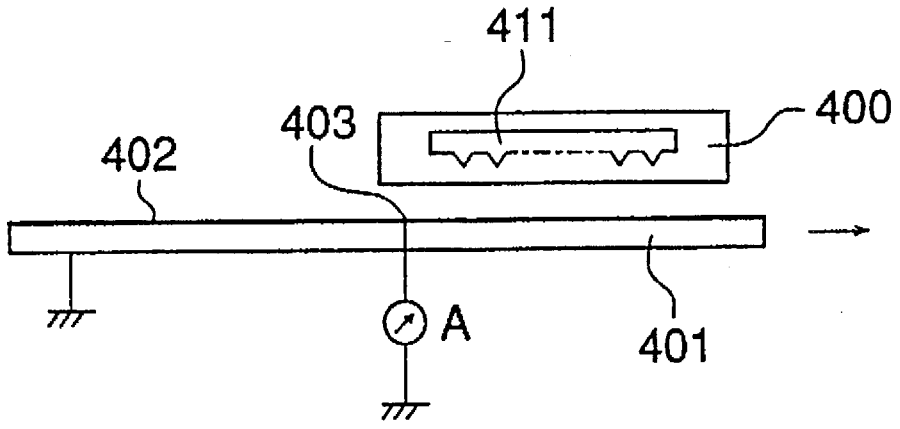
FIG. 15 is a view showing a measurement device to measure the fluctuation of charging.

The present inventors impressed a voltage upon the above scorotron charging unit 10 and measured the discharging condition with the uneven charging condition measurement device illustrated in FIG. 15. Result of the measurement is shown in FIG. 9. In FIG. 9, the horizontal axis represents the scanning time T (sec), that is, the horizontal axis represents a position of the scorotron charging unit 100 in the longitudinal direction. The vertical axis represents an electric current I (μA) flowing in a tungsten wire at each position.

FIG. 9(A) is a view showing a discharging condition in which the interval $D_p$ between the tops 111*b* of the saw-toothed electrode 111*a* was determined to be not more than 1 mm. As shown in FIG. 9(A), discharging occurred between the adjacent saw-teeth, and charging became remarkably uneven. FIG. 9(B) is a view showing a discharging condition in which the interval $D_p$ between the tops 111*b* of the saw-toothed electrode 111*a* was determined to be not less than 4 mm. As shown in FIG. 9(B), discharging did not occur between the adjacent saw-teeth, so that uneven charging occurred in accordance with the interval of the saw-teeth. In this case, discharging of each saw-toothed electrode completely independently reaches the photoreceptor drum. Accordingly, charging became remarkably uneven. As illustrated in FIG. 8, when the interval $D_p$ between the tops 111*b* of the saw-toothed electrode 111*a* is set at a value not less than 1 mm and not more than 4 mm, an interval of the points where the radial extensions of corona discharge cross with each other becomes $D_p$, and when the control grid 115 is disposed at a position where the value $D_g$ between the top 111*b* of the saw-toothed electrode 111*a* and the control grid 115 becomes not less than $2D_p$, the controlling property of the control grid is enhanced. As a result, it is possible to provide a uniform discharging condition illustrated in FIG. 9(C).

Experiments were made under the following conditions. The image forming apparatus illustrated in FIG. 5 was used. Diameter of the photoreceptor drum 10 was 180 mm, and width of the photoreceptor drum 10 was determined to be a value corresponding to the width 297 mm of size A4. In this case, the photoreceptor drum 10 was rotated at a circumferential speed of 80 mm/sec. The interval $D_p$ between the tops 111*b* of the saw-toothed electrode 111*a* was set at 3 mm. The interval $D_g$ between the top 111*b* of the saw-toothed electrode 111*a* and the control grid 115 was set at 7 mm. The radius of curvature of the top 111*b* of the saw-toothed electrode 111*a* was R=30 μm. DC voltage −4.7 kV was impressed upon the saw-toothed electrode plate 111. DC voltage −800 V was impressed upon the control grid 115. The surface voltage of the photoreceptor drum 10 was controlled at −800 V. In order to maintain the effective control property of the control grid, DC voltage −600 V, which was lower than the voltage impressed upon the control grid 115, was impressed upon the side plates 113, 114 provided on both sides of the saw-toothed electrode plate 111. As a result of the experiments, the direction of discharging from the saw-toothed electrode was inclined onto the side of the side plate. Therefore, in addition to the discharge through the control grid, the discharge through the side plate was carried out. As a result, charging was uniformly conducted, and images of quality were provided.

When the corona charging unit of the fourth example is employed, it is possible to provide an image forming apparatus in which charging is uniformly conducted and the corona charging unit is downsized, that is, the entire apparatus can be made compact. It is possible to provide a corona charging unit to be applied to the color image forming apparatus illustrated in FIG. 5 in which the compact corona charging unit is used so that charging can be uniformly conducted without deteriorating the charging performance and without generating a large amount of ozone, and in this color image forming apparatus, there are provided a corona charging unit, an image exposure unit and a plurality of developing units around the circumferential surface of the image forming body, and toner images are superimposed when the image forming body is rotated by a plurality of times and then the formed toner images are simultaneously transferred onto a transfer sheet.

The fifth example of the present invention will be described as follows.

Figure 11:
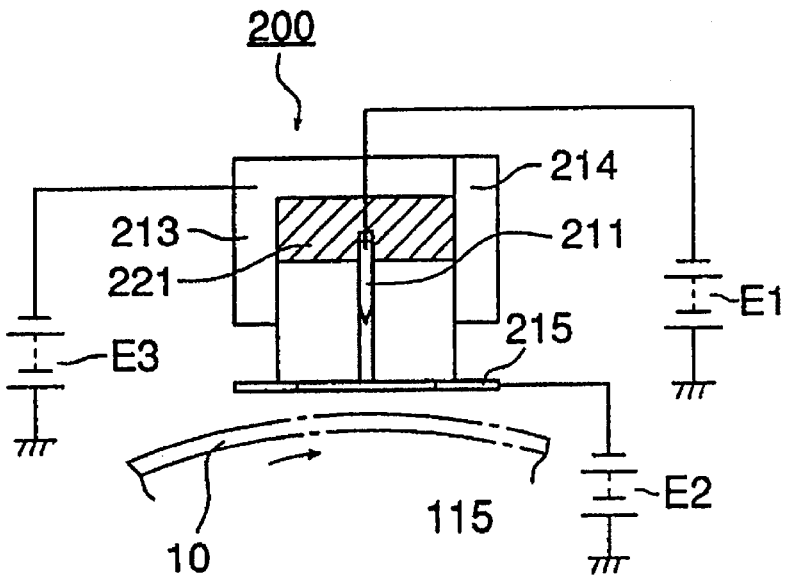
FIG. 11 is a sectional arrangement view of the scorotron charging unit shown in FIG. 10.
Figure 12:
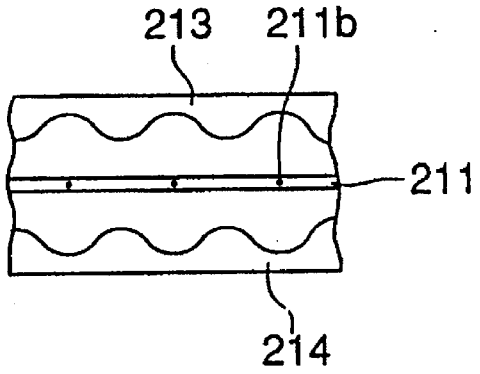
FIG. 12 is a partially enlarged view of the scorotron charging unit, wherein the view is taken from the upper side of FIG. 10.
Figure 13:
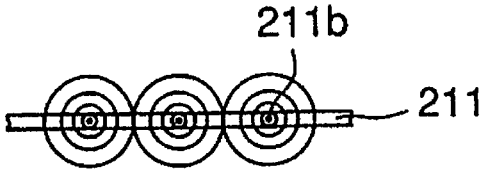
FIG. 13 is a view showing the density distribution of corona ions of the scorotron charging unit having a saw-toothed electrode.
Figure 14:
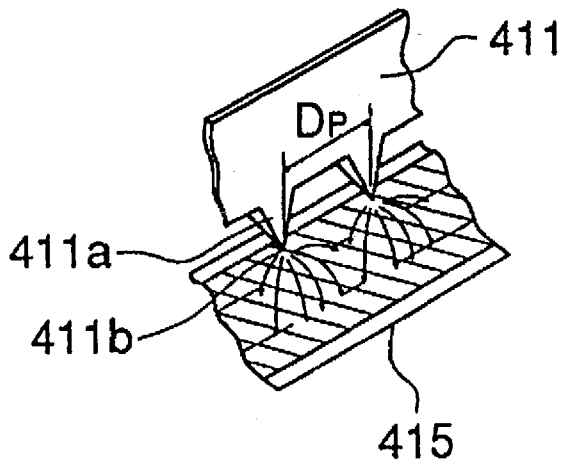
FIG. 14 is a view showing the discharging condition of the corona charging unit having a saw-toothed electrode plate.

The scorotron charging unit, which is an example of the corona charging unit of the fifth example of the present invention, will be explained with reference to FIGS. 10 to 13. FIG. 6 is a view showing an overall arrangement of the saw-toothed electrode plate of the scorotron charging unit of the fifth example. FIG. 11 is a sectional view showing the arrangement of the scorotron charging unit. FIG. 12 is a partially enlarged view of the scorotron charging unit, wherein the view is taken from the upside. FIG. 13 is a view showing the density distribution of corona ions of the scorotron charging unit in which the saw-toothed electrode is used.

The saw-toothed electrode plate 211 is provided with a saw-toothed electrode 211*a* in which a plurality of tops 211*b* of the saw-toothed electrode 211*a* are disposed at regular intervals, wherein the lengths of the saw-teeth are the same. The saw-toothed electrode plate 211 is used for corona discharging and arranged in a direction perpendicular to the moving direction of the photoreceptor drum 10 which is the image forming body. The saw-toothed electrode 211 is manufactured, for example, in such a manner that a stainless steel sheet, the thickness of which is 0.1 mm, is subjected to etching. The radius of curvature of the top 211*b* of the saw-toothed electrode 211*a* is not more than R=40 μm. The control grid 215 is manufactured, for example, in such a manner that a stainless steel sheet, the thickness of which is 0.1 mm, is subjected to etching. In this case, the mesh size is 1 mm. The side plates 213, 214, which are shield members, are formed in such a manner that the sides of the side plates 213, 214 opposed to the saw-toothed electrode plate 211 are protruded and recessed, that is, they are formed into a wave-form, wherein the intervals of the protruded and recessed portions are the same as those of the saw-toothed electrode 211*a*. Surfaces of the side plates 213, 214 are electrically conductive because the resin molding is subjected to metallic plating.

The saw-toothed electrode 211 is inserted into a groove 223 of the support member 221 made of insulating resin, for example, ABS resin. Then the saw-toothed electrode 211 is fixed to the groove 223 of the support member 221 by adhesive. The side plates 213, 214 are disposed in parallel with the longitudinal direction of the saw-toothed electrode 211 and attached to both ends of the support member 221 with screws made of resin not shown in the drawing. Further, the control grid 215 is attached to the control grid attaching faces 224, 225 provided at both ends of the support member 221. In this case, the control grid 215 is attached, for example, with screws made of resin not shown in the drawing. In this way, the scorotron charging unit 200, which is a corona charging unit, is formed. On the side plates 213, 214, there are provided protrusions and recesses, the intervals of which are the same as those of the saw-toothed electrode 211*a* formed on the saw-toothed electrode plate 211. The side plates 213, 214 are disposed in such a manner that the tops 211*b* of the saw-toothed electrode 211*a* are opposed to the recesses as illustrated in FIG. 12.

When the above scorotron charging unit 200 is attached to the apparatus being opposed to the photoreceptor drum 10 and image formation is conducted, DC voltage is impressed upon each member as follows. DC voltage E1 is impressed upon the saw-toothed electrode 211. DC voltage E2 is impressed upon the control grid 215. DC voltage E3 is impressed upon the side plates 213, 214. Corona ions are generated when the corona discharge is conducted at the tops 211*b* of the saw-toothed electrode 211*a*. The density distribution of corona ions is shown in FIG. 13. The side plates 213, 214, the intervals of protrusions and recesses of which are the same as those of the saw-toothed electrode 211*a*, are disposed in such a manner that the recesses are opposed to the tops 211*b* of the saw-toothed electrode 211*a*. Accordingly, the generated corona ions are uniformly spread to the protrusions and recesses of the side plates 213, 214 around the tops 211*b* of the saw-toothed electrode 211*a*. Accordingly, uneven charging seldom occurs, that is, charging is uniformly conducted. In this case, the intensity of the electric field is suppressed at the tops so that the leakage of electricity to the side plates can be prevented, that is, spark discharge to the side plates can be prevented.

Experiments were made under the following conditions. The image forming apparatus illustrated in FIG. 5 was used. Diameter of the photoreceptor drum 10 was 180 mm, and width of the photoreceptor drum 10 was determined to be a value corresponding to the width 297 mm of size A4. In this case, the photoreceptor drum 10 was rotated at a circumferential speed of 80 mm/sec. The interval between the tops 211*b* of the saw-toothed electrode 211*a* was set at 5 mm. The radius of curvature of the top 211*b* of the saw-toothed electrode 211*a* was R=40 μm. DC voltage −5 kV was impressed upon the saw-toothed electrode plate 211. DC voltage −600 V was impressed upon the control grid 215. The surface voltage of the photoreceptor drum 10 was controlled at −600 V. DC voltage −500 V was impressed upon the side plates 213, 214 provided on both sides of the saw-toothed electrode plate 111. As a result, charging was uniformly conducted, and images of quality were provided.

When the corona charging unit of the fourth example is employed, it is possible to provide an image forming apparatus in which charging is uniformly conducted and the corona charging unit is downsized, that is, the entire apparatus can be made compact. It is possible to provide a corona charging unit to be applied to the color image forming apparatus illustrated in FIG. 1 in which the compact corona charging unit is used so that charging can be uniformly conducted without deteriorating the charging performance and without generating a large amount of ozone, and in this color image forming apparatus, there are provided a corona charging unit, an image exposure unit and a plurality of developing units around the circumferential surface of the image forming body, and toner images are superimposed when the image forming body is rotated by a plurality of times and then the formed toner images are simultaneously transferred onto a transfer sheet.

According to the fourth example, when the interval $D_p$ between the tops of the saw-toothed electrode is set at a value not less than 1 mm and not more than 4 mm, an interval of the points where the radial extensions of corona discharge cross with each other becomes $D_p$, and when the control grid 115 is disposed at a position where the value $D_g$ between the top of the saw-toothed electrode and the control grid becomes not less than $2D_p$, the controlling property of the control grid is enhanced. As a result, it is possible to provide a uniform discharging condition.

When the side plates are individually provided on both sides, it is possible to prevent foreign objects from flowing into the apparatus. When the voltages impressed upon the side plates are separately controlled, corona discharge is controlled so that a current of ions can be maintained in a good condition.

The direction of discharge from the saw-toothed electrode is inclined toward the side plate, and in addition to the discharge through the control grid, the discharge can be conducted through the side plates. Accordingly, charging can be uniformly carried out, and images of high quality can be formed.

According to the fifth example of the present invention, there are provided side plates having protrusions and recesses, the intervals of which are the same as those of the saw-toothed electrode formed on the saw-toothed electrode plate, and the side plates are disposed in such a manner that the recesses are opposed to the tops of the saw-toothed electrode. Accordingly, corona ions generated by corona discharge are uniformly spread in the protrusions and recesses on the side plates around the tops of the saw-toothed electrode. Therefore, the fluctuation of charging is difficult to occur, and charging can be uniformly conducted. Further, an increase in the intensity of the electric field is suppressed at the tops of the saw-toothed electrode, and the leakage of electricity to the side plates is prevented.

It is possible to provide a color image forming apparatus having a compact corona charging unit by which charging can be uniformly conducted without deteriorating the charging performance. Especially, it is possible to conduct the uniform charging in the color image forming apparatus in which there are provided a corona charging unit, an image exposure unit and a plurality of developing units around the circumferential face of an image forming body, and when the image forming body is rotated by a plurality of times, the toner images are superimposed, and then the superimposed images are simultaneously transferred onto a transfer sheet. In the above case, charging can be uniformly conducted and further an amount of generated ozone is small.

The sixth example of the present invention will be explained below.

Figure 16:
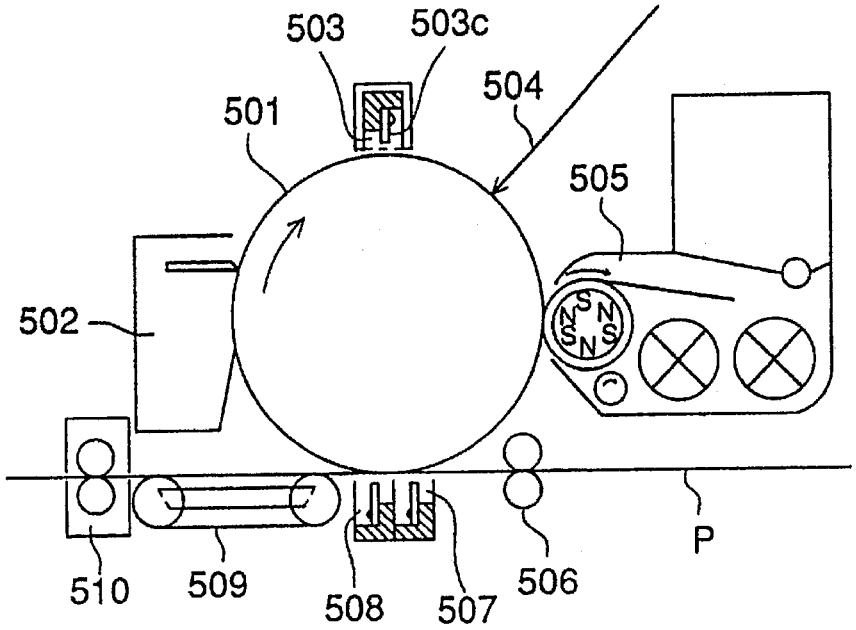
FIG. 16 is an arrangement view showing an outline of the image forming apparatus of the sixth example to accomplish the second object of the present invention.
Figure 17:
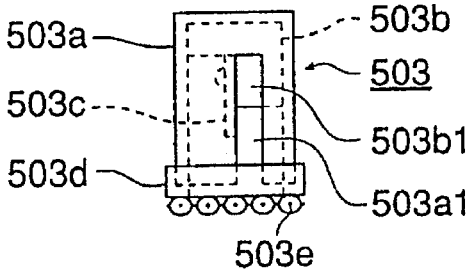
FIG. 17 is a side view on the connection terminal side to be connected with the saw-toothed discharging electrode that is an example of the charging unit of the sixth example.
Figure 18:
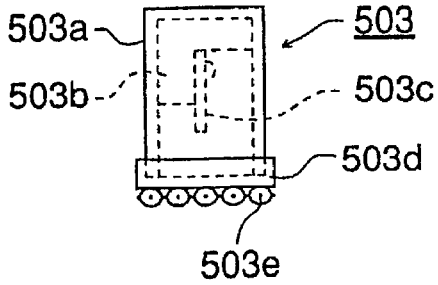
FIG. 18 is a side view of the charging unit used for the present invention, wherein the view is taken on the opposite side to FIG. 17.
Figure 19:
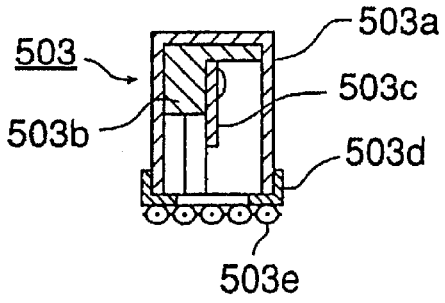
FIG. 19 is a sectional view parallel with the side of the charging unit used for the present invention.
Figure 20:
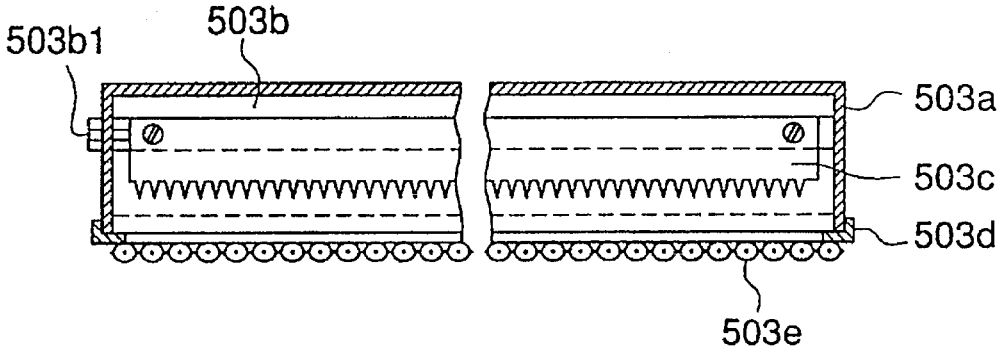
FIG. 20 is a sectional view parallel with the parallel wall of the charging unit used for the present invention.
Figure 21:
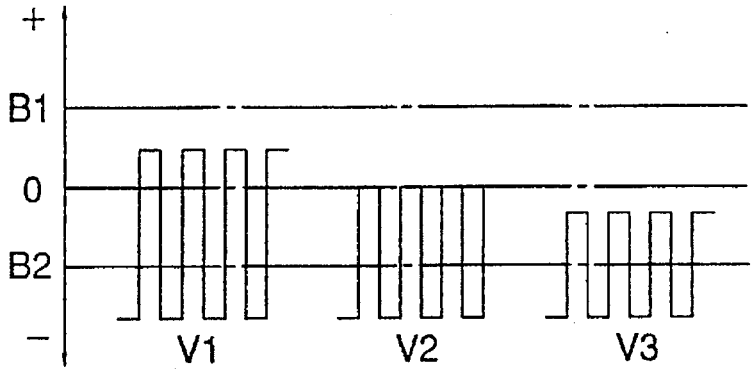
FIG. 21 is a discharge voltage graph showing an example of the rectangular wave-form voltage to be impressed upon the saw-toothed electrode of the charging unit.
Figure 22:
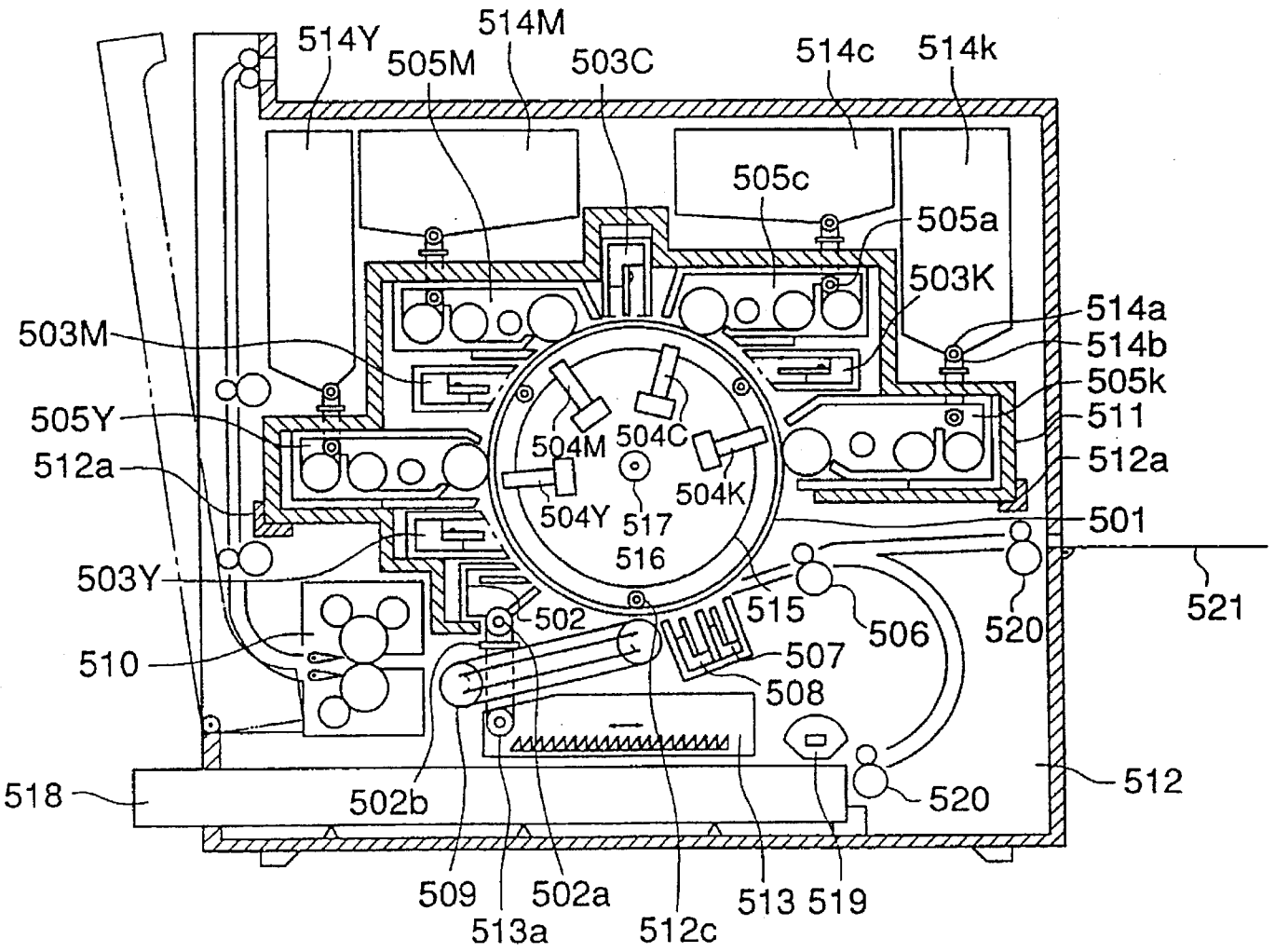
FIG. 22 is an arrangement view showing an outline of the example of the image forming apparatus of the seventh example.
Figure 23:
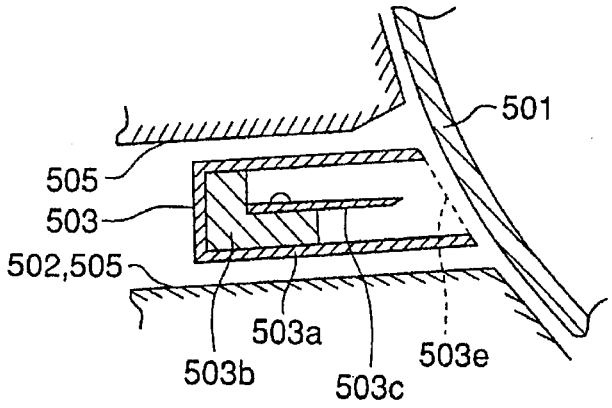
FIG. 23 is a view showing a portion of the image forming apparatus in which an example of the charging unit used for the seventh example of the present invention is shown.

FIG. 16 is an arrangement view showing an outline of the image forming apparatus of the sixth example to accomplish the second object of the present invention. FIG. 17 is a side view on the connection terminal side to be connected with the saw-toothed discharging electrode that is an example of the charging unit of the sixth example. FIG. 18 is a side view of the charging unit used for the present invention, wherein the view is taken on the opposite side to FIG. 17. FIG. 19 is a sectional view parallel with the side of the charging unit used for the present invention. FIG. 20 is a sectional view parallel with the parallel wall of the charging unit used for the present invention. FIG. 21 is a discharge voltage graph showing an example of the rectangular wave-form voltage to be impressed upon the saw-toothed electrode of the charging unit. FIG. 22 is an arrangement view showing an outline of the example of the image forming apparatus of the seventh example. FIG. 23 is a view showing a portion of the image forming apparatus in which an example of the charging unit used for the seventh example of the present invention is shown.

The sixth example of the present invention will be explained below.

The image forming apparatus shown in FIG. 16 is operated as follows. There is provided a drum-shaped image forming body 501 rotated clockwise being controlled by a control unit not shown in the drawing. A circumferential surface of the image forming body 501 is cleaned by a cleaning unit 502. Then the image forming body 501 is uniformly charged by a charging unit 503. Image exposure light 504 is incident onto the electrically charged surface by a slit exposure means or a laser beam scanner not shown in the drawing, so that an electrostatic latent image is formed. The thus formed electrostatic latent image is developed into a toner image by a developing unit 505. The thus formed toner image is transferred onto a transfer sheet P which has been conveyed from a sheet feed means not shown by a timing roller 506 in such a manner that the transfer sheet P comes into contact with the circumferential face of the image forming body 501. The transfer sheet P onto which the toner image has been transferred is separated from the image forming body 501 by the action of a separator 508. After that, the transfer sheet P is sent to a fixing unit 510 by a conveyer 509 having a suction means. After the toner image on the transfer sheet P has been fixed, the transfer sheet P is sent outside the apparatus. After the transfer, the circumferential surface of the image forming body 501 is cleaned by the cleaning unit 502 so as to prepare for the next image formation.

For the charging unit 503, a corotron charging unit is used, in which corona discharge is conducted by the saw-toothed discharging electrode 503c. Alternatively, a scorotron charging unit, the preferable detail of which is shown in FIGS. 17 to 20, is used because uniform charging can be carried out.

The charging unit 503 illustrated in FIGS. 17 to 20 comprises: a metallic casing 503*a* having a parallel wall, the length of which is approximately the same as the width of the image forming body 501, a back wall for connecting the long side of the parallel wall, and a side wall provided on both sides for connecting the short sides of the parallel wall and the back wall, wherein the open face of the metallic casing 503*a* is provided on the opposed face of the back wall; a saw-toothed discharging electrode 503*c* attached to the electrode support member 503*b* made of insulating material by means of screws or adhesion, wherein the saw-toothed discharging electrode 503*c* is fixed to the inside of the back wall of the casing 503*a* by means of screws or adhesion, so that the saw-toothed discharging electrode 503*c* is installed inside the casing 503*a* in parallel with the parallel wall; an insulating frame 503*d* fixed to the periphery of the open face of the casing 503*a*; and a control 503*e* composed of a metallic grid manufactured by means of etching which is provided on the open face of the insulating frame 503*d*.

In this structure, the electrode support member 503*b* has a protective protrusion 503*b*1 which covers a lead wire for impressing a discharging voltage upon the saw-toothed electrode 503*c* sent from a power source not shown in the drawing. The protective protrusion 503*b*1 is protruded from a side wall of the casing 503*a* through a cut-out groove 503*a*1 formed on the side wall of the casing 503*a*. Due to the foregoing structure, the lead wire is not damaged by the casing 503*a* which is grounded. Therefore, the discharging voltage can be safely supplied.

When the casing 503*a* is made of insulating material such as synthetic resin or ceramics, the saw-toothed discharging electrode 503*c* may be directly attached onto the back wall of the casing 503*a*, and the control electrode 503*e* may be directly attached onto the parallel wall of the casing 503*a*. In this way, the electrode supporting member 503*b* and the insulating frame 503*d* may be omitted.

The power source to drive the charging unit is controlled by the control unit. The power source impresses one of the rectangular wave-form voltages V1 to V3, which are shown in FIG. 21, upon the saw-toothed discharging electrode 503*c* in accordance with the type of the image forming body 501. In the same manner as the conventional scorotron charging unit, DC voltage, the polarity of which is the same as that of the discharging voltage for preventing the occurrence of uneven corona discharge, is impressed upon the control electrode 503*e*. Due to the foregoing, it is possible to electrically charge the circumferential surface of the image forming body 501 by the approximately same voltage as that impressed upon the control electrode 503*e*. Consequently, image of high quality can be formed.

On the other hand, in the case of the conventional image forming apparatus in which a DC discharging voltage or a discharging voltage composed of superimposed DC and sin wave AC is impressed, local discharge tends to occur from the saw-toothed discharging electrode 503*c*. Therefore, even if the scorotron charging unit is used for the charging unit 503, the charging voltage of the image forming body 501 tends to be uneven, and image of low quality are formed.

According to FIG. 21 in which negative charging is shown, voltages V1, V2 and V3 are described as follows. V1 is a rectangular wave-form voltage, the maximum negative voltage of which is higher than the negative discharge starting voltage B2, and the maximum voltage of which is between the positive discharge starting voltage B1 and 0; V2 is a rectangular wave-form voltage, the maximum voltage of which is higher than the negative discharge starting voltage B2, the maximum voltage of which is 0; and V3 is a rectangular wave-form voltage, the maximum negative voltage of which is higher than the negative discharge starting voltage B2, and the maximum voltage of which is between 0 and the negative discharge starting voltage B2. In other words, by these rectangular wave-form voltages V1, V2 and V3, the start and stop of discharge is periodically repeated by the saw-toothed discharge electrode 3*c* under the condition of a constant voltage. When the voltage exceeding the discharge voltage is intermittently impressed upon the saw-toothed electrode 3*c*, corona discharge from each top portion can be surely conducted, and the continuous occurrence of unnecessary discharge to make the charging voltage fluctuate can be prevented.

In order to suppress the generation of ozone and to conduct a sufficiently uniform charging so as to form an image, it is preferable that the frequencies of the rectangular wave-form voltages V1, V2 and V3 are in a range from 200 to 2000 Hz and that the maximum negative voltage at which discharge starts is in a range from 3 to 5 KV. When the frequency is lower than 200 Hz, charging can not be conducted sufficiently uniformly. When the frequency is higher than 2000 Hz, the electric power loss is increased, and the cost of the charging unit drive power source is raised. When the maximum negative voltage at which discharge is generated is lower than 3 KV, the uniformity of charging tends to be deteriorated. When the maximum negative voltage at which discharge is generated is higher than 5 KV, the generation of ozone tends to increase, so that the cost of the charging unit drive power source is raised.

It is possible to apply a conventional constant voltage or constant current power source to the charging unit drive power source. From the viewpoint of stability of the charging voltage so as to obtain an image of high quality, it is preferable to use a constant current power source. This is the same in the case where the present invention is applied to the drive power source of the transfer unit 507 or the separator 508. In this connection, in the example illustrated in the drawings, the corona discharging unit having a saw-toothed electrode is used for the transfer unit 507 and the separator 508.

The seventh example will be explained below.

The image forming apparatus illustrated in FIG. 22 is disclosed in Japanese Patent Publication Open to Public Inspection No. 307307/1993. This image forming apparatus is composed as follows. Around the outer circumference of the drum-shaped image forming body 1, there are provided a cleaning unit 502, charging units 503Y to 503K, developing units 505Y to 505K, and a transfer unit 507 which is a transfer means. Inside the drum-shaped image forming body 501, there are provided 4 sets of image exposure means 504Y to 504K. By the above image forming apparatus, it is possible to form a color image, the length of which is not less than the circumferential length. According to this image forming apparatus, image formation of the second color and after that can be carried out without being disturbed by the previously formed toner image. That is, image formation of the second color and after that can be carried out in the same manner as that of the first color. Therefore, it is possible to provide a color image having a good color balance.

In the image forming apparatus illustrated in FIG. 22, there are provided charging units 503Y to 503K having the saw-toothed discharge electrode **503*c* shown in FIGS. 17 to 20 in which an amount of generated ozone is small. At this point, the image forming apparatus illustrated in FIG. 22 is different from the image forming apparatus described in Japanese Patent Publication Open to Public Inspection No. 307307/1993. The structure of this image forming apparatus will be described in detail as follows. The casing 503*a* includes: a parallel wall, the length of which is approximately the same as the width of the image forming body 501; a back wall connecting the long sides of the parallel walls; and side walls on both sides connecting short sides of the back wall. There is provided a control electrode 503*e* attached onto the open face side opposite to the back wall of the casing 503*a*. There is provided a saw-toothed discharge electrode 503*c* having tip portions arranged at regular intervals in the direction of the width of the image forming body, wherein the tip portions are directed to the control electrode 503*e* side, and the tip portions are arranged in parallel with the parallel wall in the casing 503*a*. The scorotron charging unit is composed of the aforementioned casing 503*a*, control electrode 503*e*, and saw-toothed discharge electrode 503*c***.

In the image forming apparatus shown in FIG. 22, 4 sets of developing units 505Y to 505K are disposed in such a manner that 2 sets of them are disposed on the right of the vertical line passing through the center of the image forming body 501, and the other 2 sets of them are disposed on the left of the vertical line passing through the center of the image forming body 501. Between the upper developing unit 505M and the lower developing unit 505Y, and also between the developing units 505C and 505K, and also between the developing unit 505Y and the cleaning unit 502, 3 sets of charging units 503M, 503K, 5033Y are respectively disposed as shown in FIG. 8 in such a manner that the parallel wall of the casing **503*a* are parallel with the developing units 505Y to 505K. The control electrode 503*e* is inclined with respect to the saw-toothed discharge electrode 503*c* which is parallel with the parallel wall. In this way, the units are disposed approximately in parallel with the circumferential surface of the image forming body 501. As illustrated in FIGS. 17 to 20, the charging unit 503C disposed between the upper right and upper left developing units 505M and 505C is disposed as follows. The control electrode 503*e* is approximately perpendicular to the parallel wall of the casing 503*a* and the saw-toothed electrode 503*c*, and opposed to the circumferential surface of the image forming body 501** being in parallel with it. The aforementioned points of this image forming apparatus are different from the image forming apparatus described in Japanese Patent Publication Open to Public Inspection No. 307307/1993 in which 4 sets of charging units and developing units are radially disposed.

When 4 sets of charging units and developing units are radially disposed in the same manner as the image forming apparatus described in Japanese Patent Publication Open to Public Inspection No. 307307/1993, the following disadvantages are caused. It is relatively difficult to arrange the units. Dimensions of the apparatus tend to be increased, because the depth of the charging units 503Y, 503M, 503K having the saw-toothed discharge electrode is longer than that of the charging unit having the wire discharge electrode, so that useless spaces are generated before and after the charging units 503Y, 503M, 503K, and further the shapes of the charging units 503Y, 503M, 503K become complicated. When the aforementioned structure of the charging unit illustrated in FIG. 23 is employed, the above disadvantages can be avoided. Specifically, the structure of this example is composed as follows. The charging unit includes: a parallel wall disposed in parallel with the developing unit and the cleaning unit arranged at the upper and lower positions, wherein the length of the parallel wall is the same as that of the image forming body; a saw-toothed electrode having tip portions arranged in parallel with the parallel wall, wherein the tip portions are directed toward the circumferential surface of the image forming body; and a control electrode arranged between the saw-toothed discharge electrode and the circumferential surface of the image forming body, wherein the control electrode is inclined with respect to the saw-toothed electrode and opposed to the circumferential surface of the image forming body being approximately parallel to it. Directivity of discharging of the sheet-shaped saw-toothed electrode **503*c* is high, so that the charging efficiency of the control electrode to the image forming body is high. Therefore, an amount of discharge to the parallel walls, which are side plates, is small. Accordingly, it is possible to arrange the saw-toothed electrode 503*c* at a position close to the parallel walls. Due to the foregoing structure, in the image forming apparatus illustrated in FIG. 22, an amount of generated ozone is small, and the charging units 503Y, 503M, 503K can be arranged in parallel between the developing units 505Y to 505K and the cleaning unit 502. Accordingly, it is possible to arrange these units around the outer circumference of the image forming body 501**, so that the apparatus can be made compact.

It should be understood that the structure of the seventh example is not limited to the above example. The developing units 505Y to 505K may be disposed at positions so that they can be withdrawn to allow the movement of the cartridge frame 511 onto the side of the apparatus body 512. The image forming body 501, cleaning unit 502, charging units 503Y to 503K, and further image exposure means 504Y to 504K except for the developing units may be assembled to the cartridge frame 511. The image exposure means 504Y to 504K may be disposed outside the image forming body 501, and image exposure light may be incident onto the outer circumferential surface by a laser unit. In the above image forming apparatus, the charging unit, developing units and cleaning unit can be arranged in the same manner as the image forming apparatus shown in FIG. 7. Accordingly, it is possible to use the charging unit illustrated in FIG. 23, so that the effect of the seventh example can be provided.

The image forming apparatus 6f the sixth example provides the following effects. An amount of generated ozone is small, and the image forming body can be uniformly charged in a stable condition. Accordingly, images of high quality can be formed. The image forming apparatus of the seventh example provides the following effects. It is possible to provide a compact image forming apparatus in which an amount of generated ozone is small.

The eighth example to accomplish the third object of the present invention will be explained with reference to FIGS. 24, 26 and 27.

Figure 24:
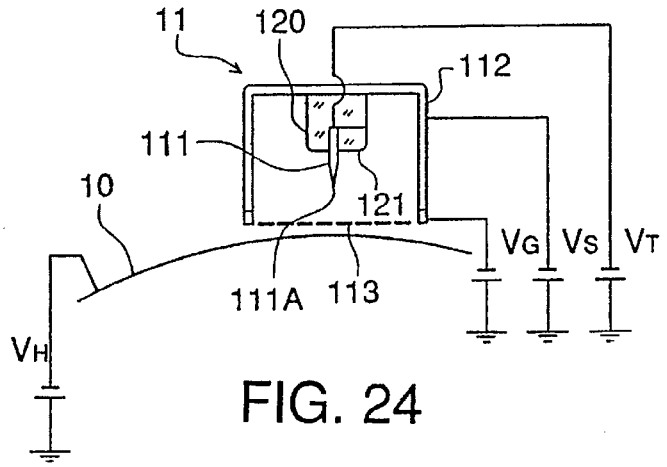
FIG. 24 is a sectional view showing the structure of the charging unit of the eighth example to accomplish the third object of the present invention.

As illustrated in FIG. 24, each charging unit 11 includes: an electrode plate 111 having a saw-toothed electrode section 111A which protrude toward the circumferential surface of the photoreceptor drum 10; a shield member 112, the sectional shape of which is a C-shape; and a control grid 113 attached to the opening portion of the shield member 112.

The electrode plate 111 is made of a stainless steel sheet, the thickness of which is 0.1 mm, wherein the stainless steel sheet is subjected to etching. The shield member 112 is made in such a manner that a stainless steel sheet is bent. The control grid 113 made of a stainless steel sheet, the thickness of which is 0.1 mm, wherein the stainless steel sheet is subjected to etching so that the stainless steel sheet is formed into a mesh-shape, the width of which is approximately 1 mm. The electrode plate 111 is attached onto the inner face of the shield member 112 via the supporting members 120, 121. On the Other hand, the control grid 113 is directly attached to the opening portion of the shield member 112 with screws not shown in the drawing.

The photoreceptor drum 10 of this example is negatively charged. Accordingly, in the case of toner image formation, voltage is impressed upon each member of the charging unit 11 as follows. When the photoreceptor drum 10 is electrically charged, the discharge voltage of VT=−5 kV or −6 kV is impressed upon the electrode plate 111. On the other hand, voltages of VS=−700 V and VG=−700 V are respectively impressed upon the shield member 112 and the control grid 113. By the corona discharge of the electrode plate 111, voltage of VH=−700 V is impressed upon the photoconductive layer provided on the circumferential surface of the photoreceptor drum 10.

In the case where images are not formed, in other words, when the image forming apparatus is in a condition of standby in which the charging operation for toner image formation is not conducted, non-discharge voltage of VT=−2 kV is impressed upon the electrode plate 111. On the other hand, voltages of S=−1 kV and VG=−1 kV are respectively impressed upon the shield member 112 and the control grid 113, wherein the polarity of the voltage is the same as the polarity of toner deposited on the photoreceptor.

Voltages impressed upon the electrode plate 111, shield member 112 and control grid 113 are higher than the charging voltage VH=−700 V of the photoreceptor drum 10. Accordingly, in the process of reversal development, the toner particles deposited on the photoconductive layer are electrically repulsed, so that the toner particles are prevented from floating and scattering. In this way, the deposition of toner particles on the charging unit 11, especially the deposition of toner particles on the electrode plate 111 can be effectively prevented.

Figure 26:
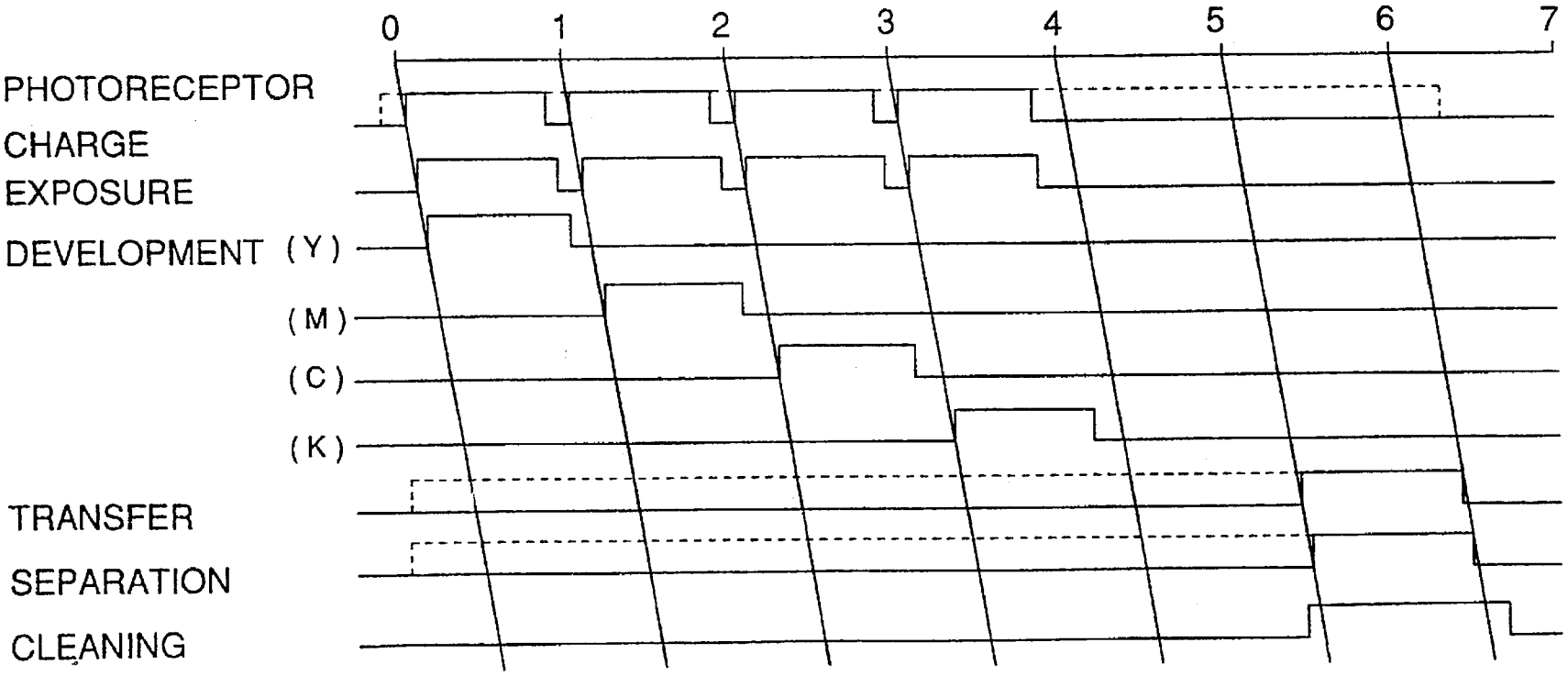
FIG. 26 is a time chart of the image formation process conducted by the multi-rotation type color image forming apparatus.

FIG. 26 is a time chart showing the image formation process conducted in the multi-rotation type color image forming apparatus illustrated in FIG. 5. As indicated by broken lines in the time chart, non-discharge voltage is impressed upon the charging unit of this apparatus in the following periods of time. They are: a period of time in which the photoreceptor drum is preliminarily rotated; a period of time corresponding to an interval from the charging to the charging of each toner image; and a period of time from the completion of image formation to the stoppage of the photoreceptor drum.

Figure 27:
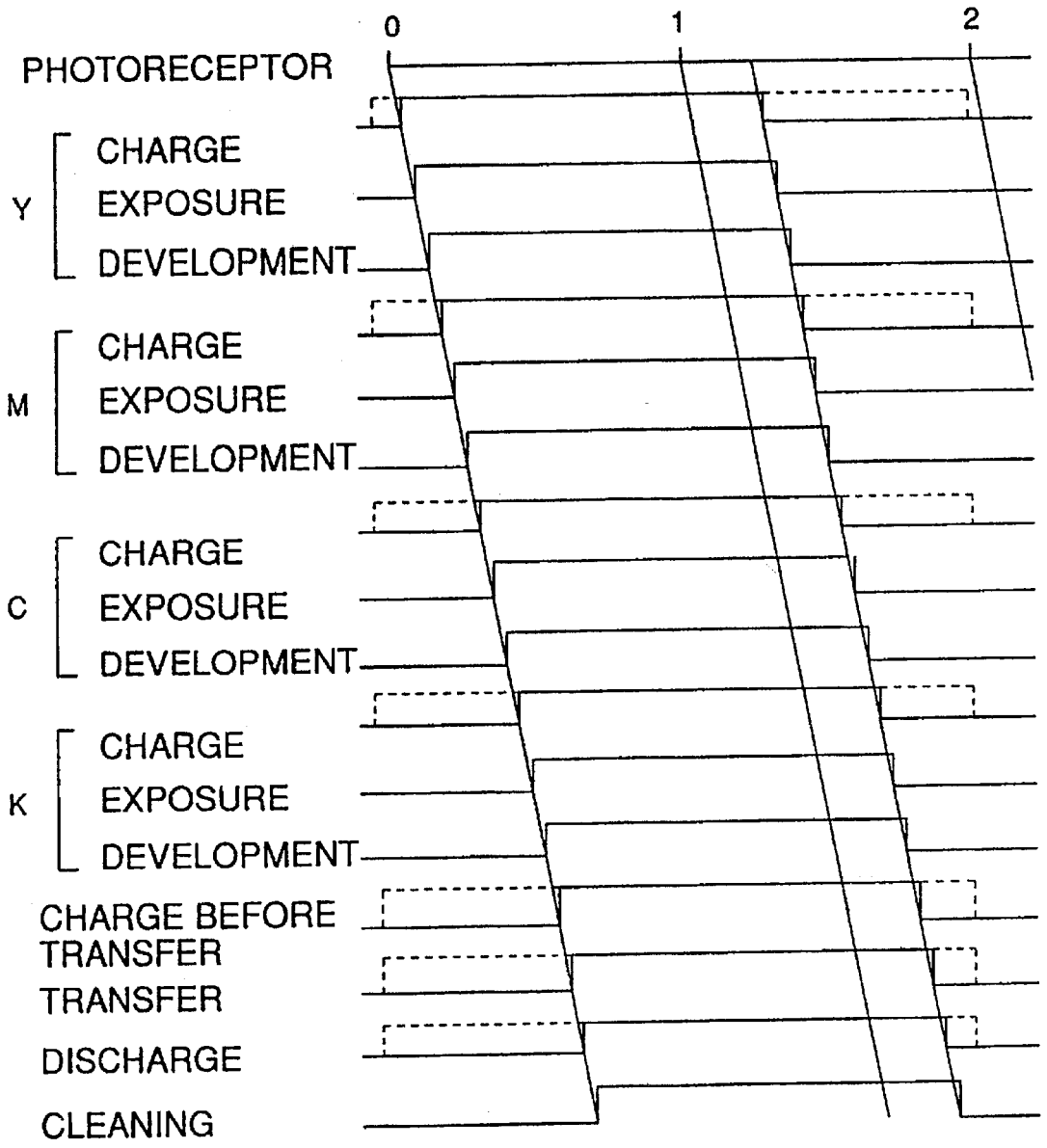
FIG. 27 is a time chart of the image formation process conducted by the single-rotation type color image forming apparatus.

FIG. 27 is a time chart showing the image formation process conducted in the single-rotation type color image forming apparatus illustrated in FIG. 4. As indicated by broken lines in the time chart, non-discharge voltage is impressed upon the charging unit of this apparatus in the following periods of time. They are: a period of time in which the photoreceptor drum is preliminarily rotated; a period of time corresponding to an interval from the charging to the charging of each toner image; and a period of time from the completion of image formation to the stoppage of the photoreceptor drum.

In this connection, the discharge voltage and non-discharge voltage are supplied from a common electric power source. By the switching operation of the power supply circuit conducted by the control unit being linked with the control of charging, the voltage to be impressed is changed over as described above.

The ninth example to accomplish the third object of the present invention will be explained with reference to FIGS. 25, 26 and 27.

Figure 25:
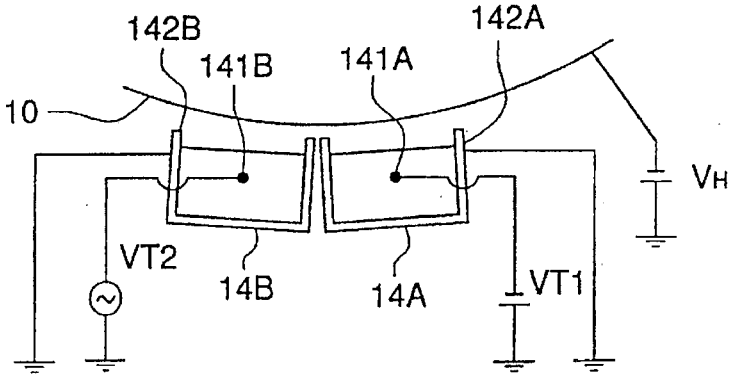
FIG. 25 is a sectional view showing the structure of the transfer and separation units of the ninth example.

As illustrated in FIG. 25, the transfer unit 14A and the separator 14B respectively include electrode wires 141A, 141B and shield members 142A, 142B, the sectional shapes of which are C-shaped, wherein the electrode wires 141A, 141B and the shield members 142A, 142B are disposed in parallel being opposed to the circumferential surface of the photoreceptor 10.

Each electrode wire described above is arranged between electrode blocks (not shown in the drawing) fixed to the ends on both sides. In the case of transfer of an image, upon the electrode wire 141A of the transfer unit 14A, a voltage of +5 kV is impressed by VT1, the polarity of which is reverse to that of toner. Due to the corona discharge of the electrode wire 141A, recording sheet P is electrically charged to the reverse polarity to that of toner. Due to the foregoing, a toner image on the photoreceptor drum 10 is transferred onto recording sheet P.

In the case of separation of recording sheet P after the toner image has been transferred, an AC discharge voltage is impressed upon the electrode wire 141B of the separator 14B by VT2. Due to the corona discharge of the electrode wire 141B, recording sheet P is electrically discharged, so that recording sheet P is separated from the circumferential surface of the photoreceptor drum 10.

In the period of time in which transfer and separation are not conducted, that is, in the period of time of a standby condition of the apparatus, and in the period of time before the transfer of an image or the separation of recording sheet P, non-discharge voltages of VT1=−2 kV and VT2=−2 kV, the polarities of which are the same as the polarity of toner, are impressed upon the electrode wires 141A, 141B of the transfer unit 14A and the separator 14B when the charging voltage of the photoreceptor drum 10 is VH=−700 V.

Polarity of each voltage impressed upon each electrode is the same as that of toner, and each voltage is higher than the charging voltage of the photoreceptor drum 10. Accordingly, toner particles deposited on the photoconductive layer by development are electrically repulsed and prevented from floating and scattering. Due to the foregoing, the trespass and deposition of toner particles onto the transfer unit 14A and separator 14B can be effectively prevented.

FIG. 26 is a time chart of the image formation process conducted by the multi-rotation type color image forming apparatus illustrated in FIG. 5. As indicated by broken lines in the time chart, non-discharge voltage is impressed upon the transfer unit and the separator in the following periods of time. They are: a period of time in which the photoreceptor drum is preliminarily rotated; and a period of time before the start of operation of transfer or separation.

FIG. 27 is a time chart showing the image formation process conducted in the single-rotation type color image forming apparatus illustrated in FIG. 4. As indicated by broken lines in the time chart, non-discharge voltage is impressed upon the transfer unit and the separator in the following periods of time. They are: a period of time in which the photoreceptor drum is preliminarily rotated; a period of time before the start of operation of transfer or separation; and a period of time from the completion of transfer or separation to the stoppage of image formation at which the rotation of the photoreceptor drum is stopped.

In the image forming apparatus including a pre-transfer charging unit which conducts corona charging on the photoreceptor drum before transfer for the purpose of adjusting the voltage of each toner image, it is possible to impress the non-discharge voltage upon the pre-transfer charging unit in addition to the transfer unit 14A and the separator 14B. In this case, the discharging voltage and the non-discharging voltage are supplied from a common electric power source. Voltage to be impressed is changed when the power supply circuit is changed over being linked with the control of transfer or separation conducted by the control section.

According to the present invention, the discharging electrodes of the charging unit, transfer unit and separator are maintained to be clean without being polluted by toner, so that the high discharging performance can be exhibited over a long period of time. As a result, it is possible to provide a color image forming apparatus by which images of high quality can be formed and the formed image can be effectively transferred onto a transfer sheet, and further the recording sheet can be effectively separated and conveyed.

What is claimed is:

1. A corona-discharging type charging device for charging a photoreceptor in an image forming apparatus, comprising:

an electrode plate having a plurality of saw tooth-shaped electrodes facing the photoreceptor;

side plates provided on both sides of the electrode plate approximately in parallel with the electrode plate, the side plates applied with a DC bias voltage Vs; and a control grid provided between the plurality of saw tooth-shaped electrodes and the photoreceptor, the control grid applied with a DC bias voltage Vg, the DC bias Voltage Vs and the DC bias voltage Vg satisfy the following inequality:

$$0.5 \leqq Vs/Vg \leqq 1.5.$$

2. A corona-discharging type charging device for charging a photoreceptor in an image forming apparatus, comprising:

an electrode plate having a plurality of saw tooth-shaped electrodes facing the photoreceptor;

side plates provided on both sides of the electrode plate approximately in parallel with the electrode plate, the side plates applied with a DC bias voltage Vs; and a control grid provided between the plurality of saw tooth-shaped electrodes and the photoreceptor, the control grid applied with a DC bias voltage Vg;

an electric current It in the saw tooth-shaped electrode and an electric current Is in the side plate satisfy the following inequality:

$$0.25 \leqq Is/It \leqq 0.75.$$

3. A corona-discharging type charging device for charging a photoreceptor in an image forming apparatus, comprising:

an electrode plate having a plurality of saw tooth-shaped electrodes facing the photoreceptor;

side plates provided on both sides of the electrode plate approximately in parallel with the electrode plate, the side plates applied with a DC bias voltage Vs; and a control grid provided between the plurality of saw tooth-shaped electrodes and the photoreceptor, the control grid applied with a DC bias voltage Vg;

a distance Ds between the electrode plate and the side plates and a distance Dg between the apex of the saw tooth-shaped electrode and the control grid satisfy the following inequality:

$$0 \leqq (Ds-Dg) \leqq 5 \text{ mm}.$$

4. A corona-discharging type charging device for charging a photoreceptor in an image forming apparatus, comprising:

an electrode plate having a plurality of saw tooth-shaped electrodes facing the photoreceptor aligned in a line with an equal pitch;

side plates provided on both sides of the electrode plate approximately in parallel with the electrode plate, the side plates applied with a DC bias voltage Vs;

a control grid provided between the plurality of saw tooth-shaped electrodes and the photoreceptor, the control grid applied with a DC bias voltage Vg;

a distance DP between the apexes of neighboring saw tooth-shaped electrodes and a distance Dg between the apex of the saw tooth-shaped electrodes and the control grid satisfy the following inequality:

$$1 \text{ mm} \leqq Dp \leqq 4 \text{ mm and } Dg \leqq 2 \times D.$$

5. A corona-discharging type charging device for charging a photoreceptor in an image forming apparatus, comprising:

an electrode plate having a plurality of saw tooth-shaped electrodes facing the photoreceptor;

side plates provided on both sides of the electrode plate approximately in parallel with the electrode plate, the side plates applied with a DC bias voltage Vs; and a control grid provided between the plurality of saw tooth-shaped electrodes and the photoreceptor, the control grid applied with a DC bias voltage Vg;

the plurality of saw tooth-shaped electrodes are aligned in a line with an equal pitch, an internal side surface of each of the side plates is shaped in a wave form in which a concave portion and a convex portion are alternately arranged with the same pitch as that of the plurality of saw tooth-shaped electrodes, and the apex of the saw tooth-shaped electrode corresponds in a position to the concave portion of the side plates.

6. A corona-discharging type charging device for charging a photoreceptor in an image forming apparatus, comprising:

an electrode plate having a plurality of saw tooth-shaped electrodes facing the photoreceptor and is applied with a rectangular wave-form voltage;

side plates provided on both sides of the electrode plate approximately in parallel with the electrode plate, the side plates applied with a DC bias voltage Vs; and a control grid provided between the plurality of saw tooth-shaped electrodes and the photoreceptor, the control grid applied with a DC bias voltage Vg.

7. The corona-discharging type charging device of claim 6, wherein the rectangular wave-form voltage is composed of a first voltage level with which a corona-discharging is conducted and a second voltage level with which a corona-discharging is not conducted.

8. The corona-discharging type charging device of claim 6, wherein the frequency of the rectangular wave-form voltage is 200 Hz to 2000 Hz.

9. The corona-discharging type charging device of claim 6, wherein the rectangular wave-form voltage is supplied from a constant current source.

10. The corona-discharging type charging device of claim 9, wherein the image forming apparatus is a color image forming apparatus, comprising:

an exposure device for exposing the photoreceptor so as to form a latent image on the photoreceptor;

plural developing devices differing in color for developing the latent image with plural color toners charged with either plus or minus sign;

a controller to control the charging device, the exposure device and the plural developing devices so that the charging, the exposing and the developing are repeated and plural color toner images differing in color are superimposed on the photoreceptor;

a transfer device for transferring the plural color toner images at a time from the photoreceptor to a recording sheet; wherein when the charging device does not work to charge the photoreceptor, the electrode plate, the side plates, and the control grid are applied with a non-discharging electric voltage of the same sign as that of the toners.

11. The corona-discharging type charging device of claim 10, wherein the non-discharging electric voltage is higher than a charged electric potential of the photoreceptor.

12. The corona-discharging type charging device of claim 10, wherein the non-discharging electric voltage for the electrode plate is higher than that for the side plates and the control grid.

13. The corona-discharging type charging device of claim 10, wherein when the transfer device dose not work to transfer the toner image, the transfer device is applied with a non-discharging electric voltage of the same sign as that of the toners.

14. A corona-discharging type charging device for charging a photoreceptor in an image forming apparatus, comprising:

an electrode plate having a plurality of saw tooth-shaped electrodes facing the photoreceptor;

side plates provided on both sides of the electrode plate approximately in parallel with the electrode plate, the side plates applied with a DC bias voltage Vs; and a control grid provided between the plurality of saw tooth-shaped electrodes and the photoreceptor, the control grid applied with a DC bias voltage Vg, further comprising an exposure device for exposing the photoreceptor so as to form a latent image on the photoreceptor;

plural developing devices differing in color for developing the latent image with plural color toners charged with either plus or minus sign;

a controller to control the charging device, the exposure device and the plural developing devices so that the charging, the exposing and the developing are repeated and plural color toner images differing in color are superimposed on the photoreceptor; and a transfer device for transferring the plural color toner images at a time from the photoreceptor to a recording sheet; wherein the corana-discharging type charging device is provided between the developing devices or between the developing devices and a cleaning device in parallel to the developing devices in the axial direction of the photoreceptor, and wherein the control grid is inclined in relation to the electrode plate and is parallel to the circumferential surface of the photoreceptor.

15. The corona-discharging type charging device of claim 14, wherein the cleaning device, the charging device, the developing devices and the transfer device are provided on the outside of the photoreceptor.

16. The corona-discharging type charging device of claim 14, wherein the exposure device is provided in the inside of the photoreceptor.

17. The corona-discharging type charging device of claim 14, wherein the photoreceptor, the cleaning device, and the charging device are integrally mounted on or dismounted from a body of the image forming apparatus as one unit.

18. The corona-discharging type charging device of claim 14, wherein the exposure device is provided rotatably in relation to the photoreceptor, and is integrally mounted on or dismounted from a body of the image forming apparatus as one unit with the cleaning device and the charging device.

* * * * *